US012560320B2

(12) United States Patent
Li et al.

(10) Patent No.: US 12,560,320 B2
(45) Date of Patent: Feb. 24, 2026

(54) ENERGY-EFFICIENT UPSIDE-ENTRAINMENT BURNING SYSTEM

(71) Applicant: Guangdong Sleek Intelligent Technology Co., Ltd, Foshan (CN)

(72) Inventors: Zhoucheng Li, Chongzuo (CN); Fa'en Shi, Ganzhou (CN); Xiaorong Tian, Ziyang (CN); Qiuxia Mo, Zhaoqing (CN); Weideng Mo, Foshan (CN); Baohua Ai, Zhongshan (CN); Yuanlin Yang, Meizhou (CN); Yunzhen Mo, Guilin (CN)

(73) Assignee: Guangdong Sleek Intelligent Technology Co., Ltd, Foshan (CN)

( * ) Notice: Subject to any disclaimer, the term of this patent is extended or adjusted under 35 U.S.C. 154(b) by 366 days.

(21) Appl. No.: 18/217,746

(22) Filed: Jul. 3, 2023

(65) Prior Publication Data

US 2024/0295318 A1 Sep. 5, 2024

(30) Foreign Application Priority Data

Mar. 3, 2023 (CN) ..... 202310203526.9

(51) Int. Cl.
*F23D 14/06* (2006.01)

(52) U.S. Cl.
CPC ..... *F23D 14/06* (2013.01)

(58) Field of Classification Search
CPC ..... F23D 14/06; F23D 2900/14062; F23D 2900/14063; F23D 14/065
USPC ..... 126/39 R, 39 E; 431/355, 284, 354
See application file for complete search history.

(56) References Cited

U.S. PATENT DOCUMENTS

2019/0107287 A1* 4/2019 Kitabayashi ..... F23N 3/007

FOREIGN PATENT DOCUMENTS

WO WO-2010105748 A2 * 9/2010 ..... F23D 14/02

* cited by examiner

*Primary Examiner* — Vivek K Shirsat
(74) *Attorney, Agent, or Firm* — Birchwood IP

(57) ABSTRACT

The present disclosure discloses an energy-efficient upside-entrainment burning system, which includes: a gas distributor component, an ejection pipe component, an outer-ring burner cap, an inner-ring burner cap, a plurality of gas nozzles. The ejection pipe component is arranged below gas distributor component, is provided with two ejection channels in a centrosymmetric structure corresponding to the outer-ring gas mixing chamber, also provided with two ejection channels in a centrosymmetric structure corresponding to inner-ring gas mixing chamber. Each ejection channel is arranged in a Venturi pipe structure. In a gas flowing direction, an ejection pipe inlet, a contraction section, a throat section, an expansion section, an ejection pipe outlet are arranged in sequence. An ejection capability is taken as a target parameter, each ejection capability parameter is of adjustment simulation to obtain optimum design of each structural detail of burner to form the energy-efficient upside-entrainment burning system with an optimum ejection capability.

7 Claims, 18 Drawing Sheets

ENERGY-EFFICIENT UPSIDE-ENTRAINMENT BURNING SYSTEM

CROSS-REFERENCE TO RELATED APPLICATIONS

This application claims the benefit and priority of Chinese patent application No. 202310203526.9, filed on Mar. 3, 2023, disclosure of which is hereby incorporated by reference in its entirety.

TECHNICAL FIELD

The present disclosure relates to the technical field of gas cookers, and in particular, to an energy-efficient upside-entrainment burning system.

BACKGROUND

As a main combustion component of a gas cooker, the combustion efficiency of the burner has always been a focus of design and research of manufacturers. In the existing burner, the effect of improving a mixing ratio of fuel and air is generally improved by the extending a gas supply channel path in an ejection pipe, so as to improve the combustion efficiency. This structure of the burner has limited improvement on the combustion efficiency. Due to the lack of further consideration, optimization, and debugging of structural details such as an ejection structure of a gas distributor, an ejection pipe, gas nozzle, and a burner cap, limited improvement on the combustion efficiency is caused. Therefore, it is necessary to perform further optimization design on the whole body of a burner system.

SUMMARY

The present disclosure aims to at least solve one of the technical problems in the prior art. In view of this, the present disclosure provides an energy-efficient upside-entrainment burning system.

The technical solution adopted by an embodiment of the present disclosure to solve its technical problem is that: an energy-efficient upside-entrainment burning system includes a gas distributor component, an ejection pipe component, an outer-ring burner cap, an inner-ring burner cap, and a plurality of gas nozzles.

The gas distributor component is provided with an inner-ring gas mixing chamber and an outer-ring gas mixing chamber that are arranged annularly. The inner-ring burner cap and the outer-ring burner cap respectively cover above the inner-ring gas mixing chamber and the outer-ring gas mixing chamber. The ejection pipe component is arranged below the gas distributor component, is provided with two ejection channels in a centrosymmetric structure corresponding to the outer-ring gas mixing chamber, and is also provided with two ejection channels in a centrosymmetric structure corresponding to the inner-ring gas mixing chamber. A gas nozzle is arranged at a gas inlet end of each ejection channel.

The ejection channel is arranged in a Venturi pipe structure. In a gas flowing direction, an ejection pipe inlet, a contraction section, a throat section, an expansion section, and an ejection pipe outlet are arranged in sequence.

Optionally, a value of a hole diameter of the throat section of the ejection channel communicated with the inner-ring gas mixing chamber ranges from 6 mm to 8 mm; and a value of a hole diameter of the throat section of the ejection channel communicated with the outer-ring gas mixing chamber ranges from 9 mm to 10 mm.

Optionally, a value of an axial distance between the ejection pipe inlet of the ejection channel communicated with the inner-ring gas mixing chamber and the gas nozzle ranges from −2 mm to 2 mm; and a value of an axial distance between the ejection pipe inlet of the ejection channel communicated with the outer-ring gas mixing chamber and the gas nozzle ranges from −3 mm to 1 mm.

Optionally, the contraction section is of a conical structure that gradually contracts, and a value of a cone angle of the contraction section ranges from 35° to 40°.

Optionally, an air channel is arranged in an axial direction of the gas nozzle; and the air channel is provided with an air inlet section, an air ejection section, and an air outlet section are arranged in sequence.

The air inlet section is of a conical angle-shaped structure that gradually contracts; a nozzle throat is also arranged between the air inlet section and the air ejection section; and a plurality of nozzle ejection ports are formed in the periphery of the air ejection section in a radial direction.

Optionally, a value of a cone angle of the contraction section ranges from 37° to 45°.

Optionally, a value of a hole diameter of the nozzle ejection port ranges from 5 mm to 6 mm.

Optionally, a plurality of fire holes are arranged in the circumferential directions of the outer-ring burner cap and the inner-ring burner cap; a value of an inclination angle of the fire hole ranges from 35° to 40°; and a value of a hole diameter of the fire hole ranges from 2.7 mm to 2.9 mm.

Optionally, the ejection pipe component includes an ejection pipe seat and an ejection pipe cap that are capable of being disassembled and assembled; and the ejection pipe cap is capable of being embedded into the ejection pipe seat, and encloses to form the ejection channel.

The present disclosure has the beneficial effects that: the ejection pipe component is arranged below the gas distributor component, is provided with two ejection channels in a centrosymmetric structure corresponding to the outer-ring gas mixing chamber, and is also provided with two ejection channels in a centrosymmetric structure corresponding to the inner-ring gas mixing chamber; due to the two ejection channels arranged in central symmetry, gas may form a rotating gas flow in the annular gas mixing chamber, and is rotated and supplied through two symmetrical gas flows. The gas flow may be rotated and mixed repeatedly in the annular gas mixing chamber, which effectively improves the mixing degree of the gas in the gas mixing chamber, and improves the combustion efficiency of outer-ring gas. According to the present disclosure, an ejection capability is taken as a target parameter, and adjustment simulation are performed by taking a single variable. For single values of parameters, such as the hole diameter of the throat in the ejection channel, the axial distance between the gas nozzle and the ejection pipe inlet, the value of the cone angle of the contraction section of the ejection pipe, the value of the cone angle of the air inlet section of the gas nozzle, the value of the hole diameter of the nozzle ejection port of the gas nozzle, the value of the inclination value of the burner cap fire hole, and the value of the hole diameter of the burner cap fire hole, each ejection capability parameter is checked in a manner of adjustment simulation to obtain an optimum design of each structural detail of a burner, so as to form the energy-efficient upside-entrainment burning system with an optimum ejection capability.

BRIEF DESCRIPTION OF DRAWINGS

The above and/or additional aspects and advantages of the present disclosure will become apparent and readily understood from the description of the embodiments in combination with the accompanying drawings.

Figure 1:
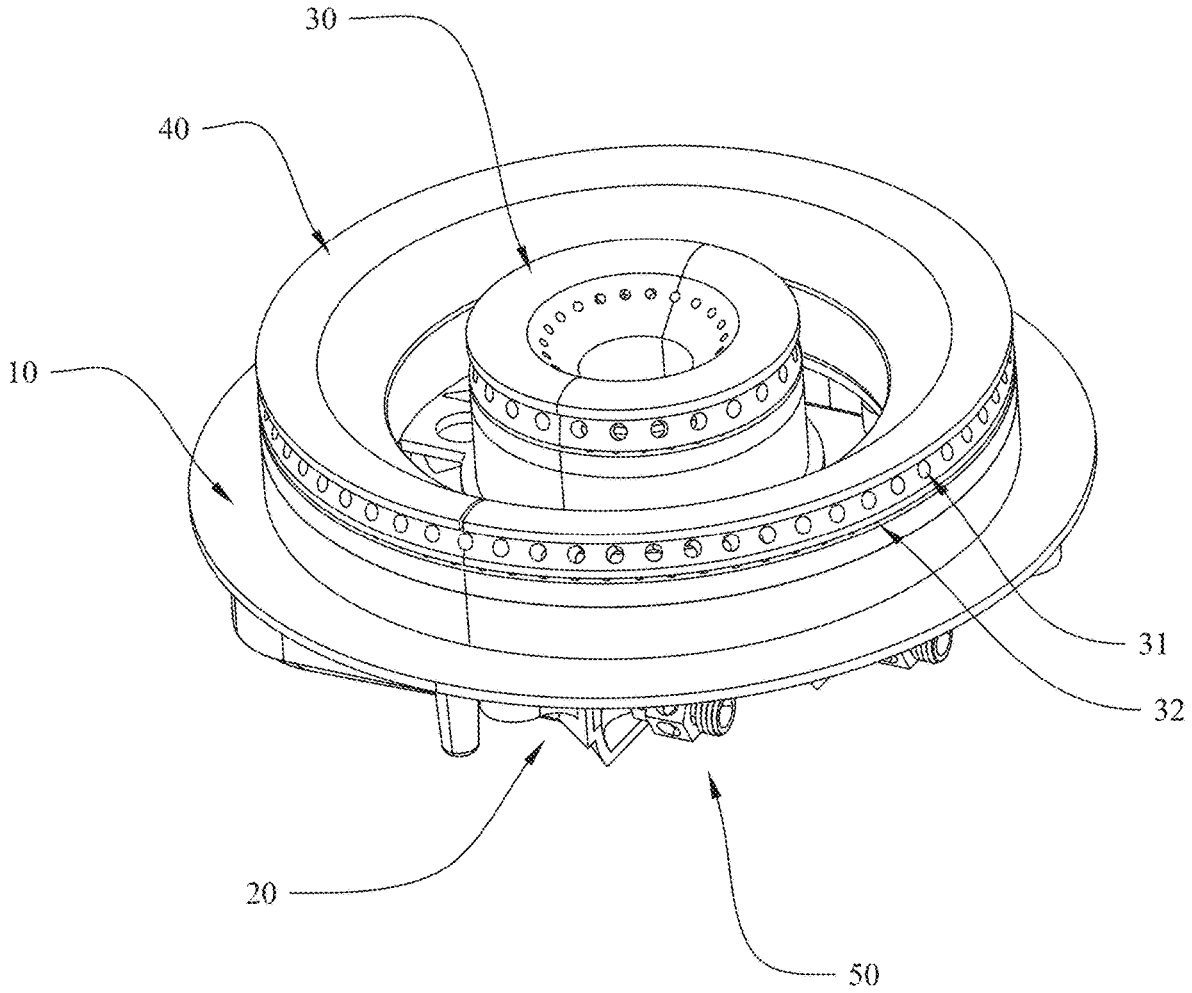
FIG. 1 is a structural schematic diagram of an energy-efficient upside-entrainment burning system of the present disclosure.
Figure 2:
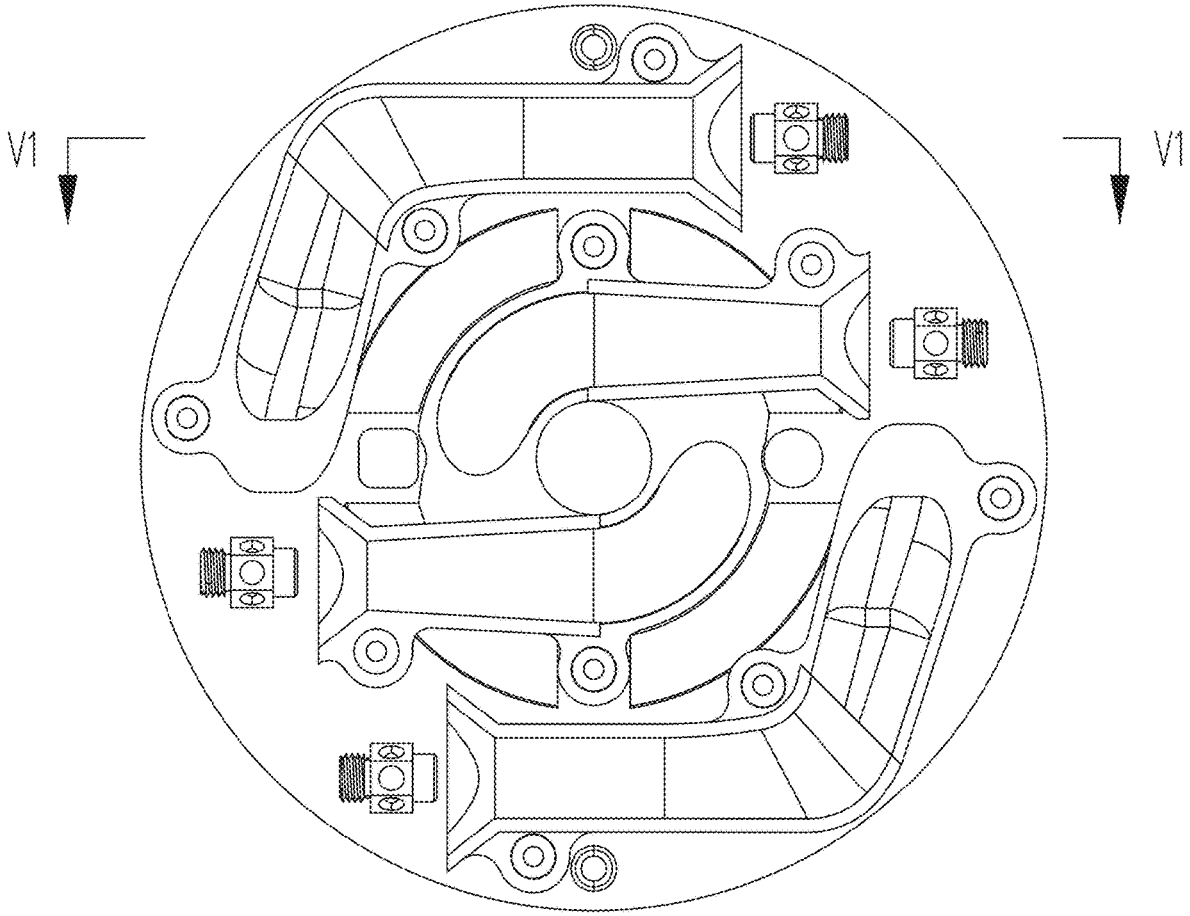
FIG. 2 is a vertical view of an upside-entrainment burning system in FIG. 1.
Figure 3:
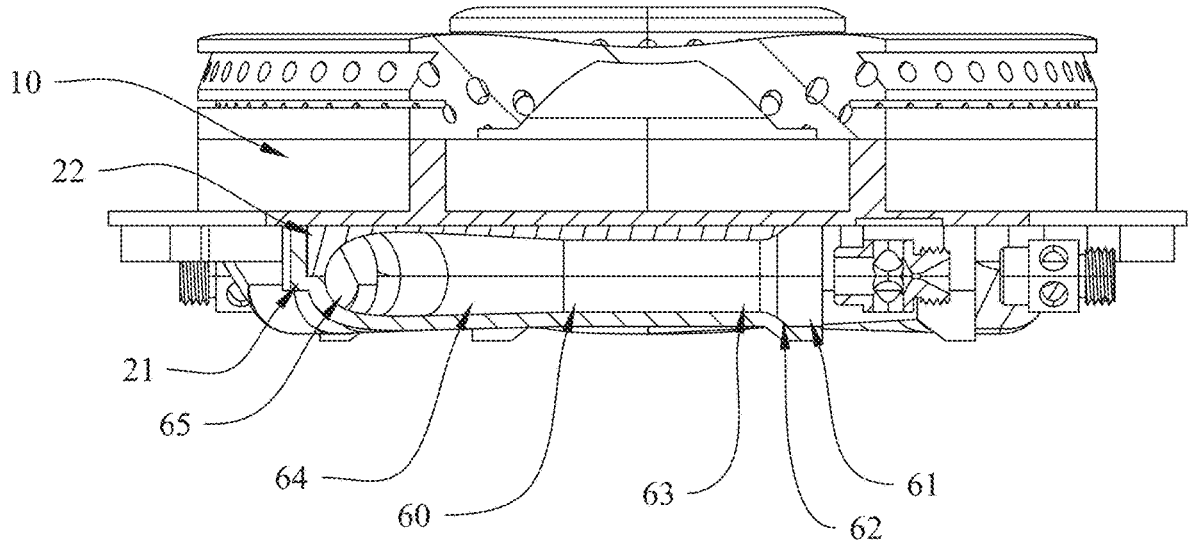
FIG. 3 is a sectional view along V1-V1 in FIG. 2.
Figure 4:
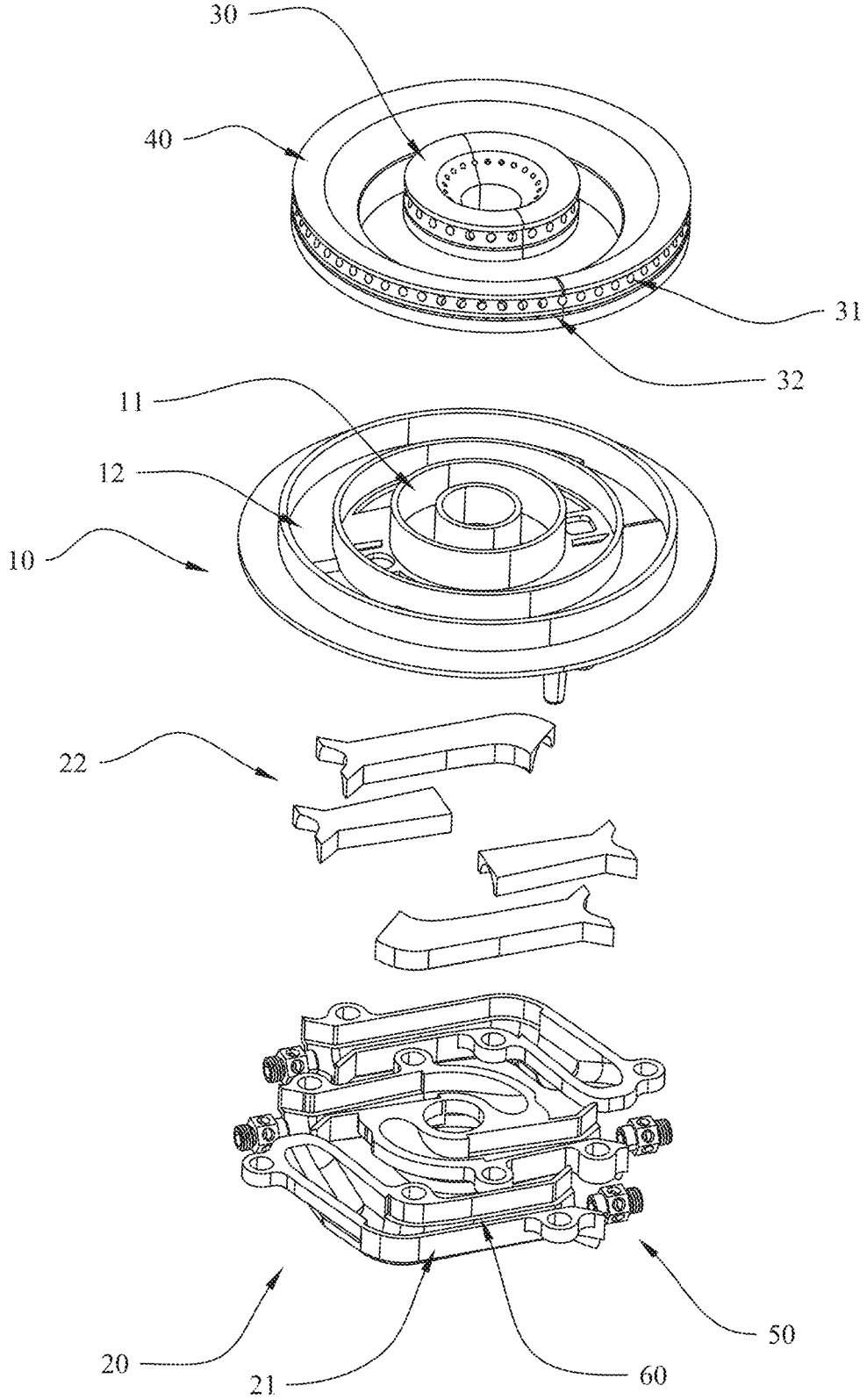
FIG. 4 is a decomposition diagram of an upside-entrainment burning system in FIG. 1.

Reference signs in the drawings:

10, gas distributor component; 11, inner-ring gas mixing chamber; 12, outer-ring gas mixing chamber; 20, ejection pipe component; 21, ejection pipe seat; 22, ejection pipe cap; 30, inner-ring burner cap; 31, fire hole; 32, flame stabilizing hole; 33, shield; 40, outer-ring burner cap; 50, gas nozzle; 51, gas inlet section; 52, nozzle throat; 53, air ejection section; 531, nozzle ejection port; 54, gas outlet section; 60, ejection channel; 61, ejection pipe inlet; 62, contraction section; 63, throat section; 64, expansion section; and 65, ejection pipe outlet.

DETAILED DESCRIPTION

This part will describe specific embodiments of the present disclosure. Optimum embodiments of the present disclosure are shown in the accompanying drawings. The function of the accompanying drawings is to supplement the description of the text part of the specification with graphics, so that people can intuitively and vividly understand each technical feature and overall technical solution of the present disclosure, but it cannot be understood as a limitation to the protection scope of the present disclosure.

In the description of the present disclosure, "a plurality of" means two or more, "greater than, less than, more than, and the like" are construed as excluding the number, and "above, below, within, and the like" are construed as including the number. If "first" and "second are described, they are only used for distinguishing technical features, but cannot be construed as indicating or implying relative importance or implicitly indicating the number of indicated technical features or implicitly indicating the precedence relationship of the indicated technical features.

In the description of the present disclosure, it is to be understood that orientation description is involved, for example, orientations or positional relationships indicated by "upper", "lower", "front", "rear", "left", "right", and the like are orientations or positional relationships shown based on the accompanying drawings, they are merely used for the convenience of describing the present disclosure and simplifying the description, rather than indicating or implying that the devices or elements must have particular orientations, and constructed and operated in particular orientations. Thus, it cannot be construed as a limitation to the present disclosure.

In the present disclosure, unless otherwise specified, words "arrange", "mount", "connect", and the like should be broadly understood. For example, the terms may refer to direct connection, or indirect connection through an intermediate medium, or may be fixed connection or detachable connection, or integrated molding, or may be mechanical connection, or may be communication inside two components or an interaction relationship of the two components. Those skilled in the art can reasonably determine specific meanings of the abovementioned words in the present disclosure in combination with the specific content of the technical solution.

EMBODIMENT

Referring to FIG. 1 to FIG. 7, an energy-efficient upside-entrainment burning system provided by the present disclosure includes a gas distributor component 10, an ejection pipe component 20, an outer-ring burner cap 40, an inner-ring burner cap 30, and a plurality of gas nozzles 50.

The gas distributor component 10 is provided with an inner-ring gas mixing chamber 11 and an outer-ring gas mixing chamber 12 that are arranged annularly. The inner-ring burner cap 30 and the outer-ring burner cap 40 respectively cover above the inner-ring gas mixing chamber 11 and the outer-ring gas mixing chamber 12. The ejection pipe component 20 is arranged below the gas distributor component 10, is provided with two ejection channels 60 in a centrosymmetric structure corresponding to the outer-ring gas mixing chamber 12, and is also provided with two ejection channels 60 in a centrosymmetric structure corresponding to the inner-ring gas mixing chamber 11. A gas nozzle 50 is arranged at a gas inlet end of each ejection channel 60.

The ejection channel 60 is arranged in a Venturi pipe structure; and in a gas flowing direction, an ejection pipe inlet 61, a contraction section 62, a throat section 63, an expansion section 64, and an ejection pipe outlet 65 are arranged in sequence.

In the present disclosure, the ejection pipe component 20 is arranged below the gas distributor component 10, is provided with two ejection channels 60 in a centrosymmetric structure corresponding to the outer-ring gas mixing chamber 12, and is also provided with two ejection channels 60 in a centrosymmetric structure corresponding to the inner-ring gas mixing chamber 11; due to the two ejection channels 60 arranged in central symmetry, gas may form a rotating gas flow in the annular gas mixing chamber, and is rotated and supplied through two symmetrical gas flows. The gas flow may be rotated and mixed repeatedly in the annular gas mixing chamber, which effectively improves the mixing degree of the gas in the gas mixing chamber, and improves the combustion efficiency of outer-ring gas. According to the present disclosure, an ejection capability is taken as a target parameter, and adjustment simulation are performed by taking a single variable. For single values of parameters, such as the hole diameter of the throat in the ejection channel 60, the axial distance between the gas nozzle 50 and the ejection pipe inlet 61, the value of the cone angle of the contraction section 62 of the ejection pipe, the value of the cone angle of the air inlet section 51 of the gas nozzle 50, the value of the hole diameter of the nozzle ejection port 531 of the gas nozzle 50, the value of the inclination value of the burner cap fire hole 31, and the value of the hole diameter of the burner cap fire hole 31, each ejection capability parameter is checked in a manner of adjustment simulation to obtain an optimum design of each structural detail of a burner, so as to form the energy-efficient upside-entrainment burning system with an optimum ejection capability.

Parameters such as an average flow velocity of an overall burner and ejecting coefficients at positions of a fire hole 31 or a flame stabilizing hole 32 of a burner cap can be obtained by establishing a simulation geometric model corresponding to an upside-entrainment burner in FIG. 1 and simulating flowing states of gas and air, so as to reflect a relationship between the overall burner and a target parameter, thereby seeking optimum design values.

Figure 8:
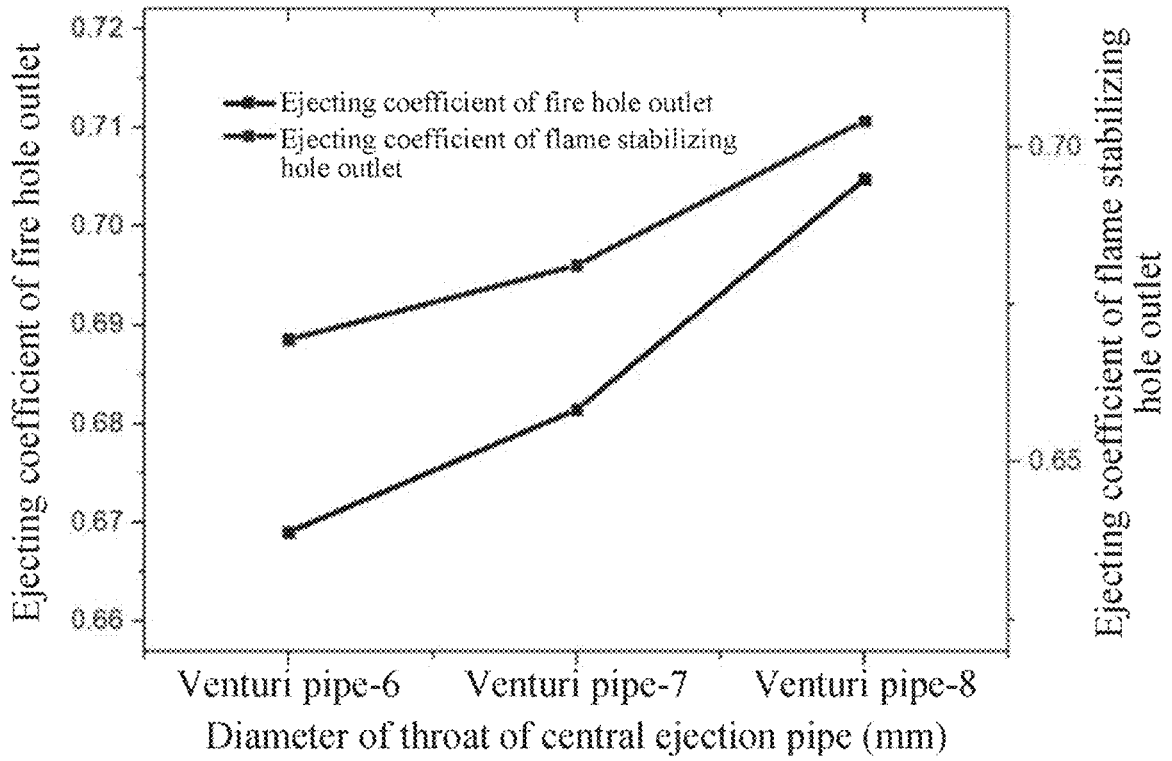
FIG. 8 is a relationship diagram between a diameter of a throat of a central ejection pipe and ejecting coefficients of a fire hole and a flame stabilizing hole of a burner cap.

Taking a hole diameter of a throat of a central ejection pipe being a target parameter as a variable, a relationship between an ejecting coefficient of an outlet of the burner cap fire hole 31 and an ejecting coefficient of an outlet of a pressure stabilizing hole is as shown in FIG. 8 by simulating and calculating different hole diameter values, and it can be known from analysis that:

when a diameter of a throat of a tapering section of a central Venturi pipe increases from 6 mm to 8 mm, the ejecting coefficient of the outlet of the fire hole 31 increases gradually, and the maximum is 0.71; the ejecting coefficient of the outlet of the flame stabilizing hole 32 also increases gradually, and the maximum is 0.70; and an optimum value of the diameter of the tapering section of the central Venturi pipe is 8 mm.

Figure 9:
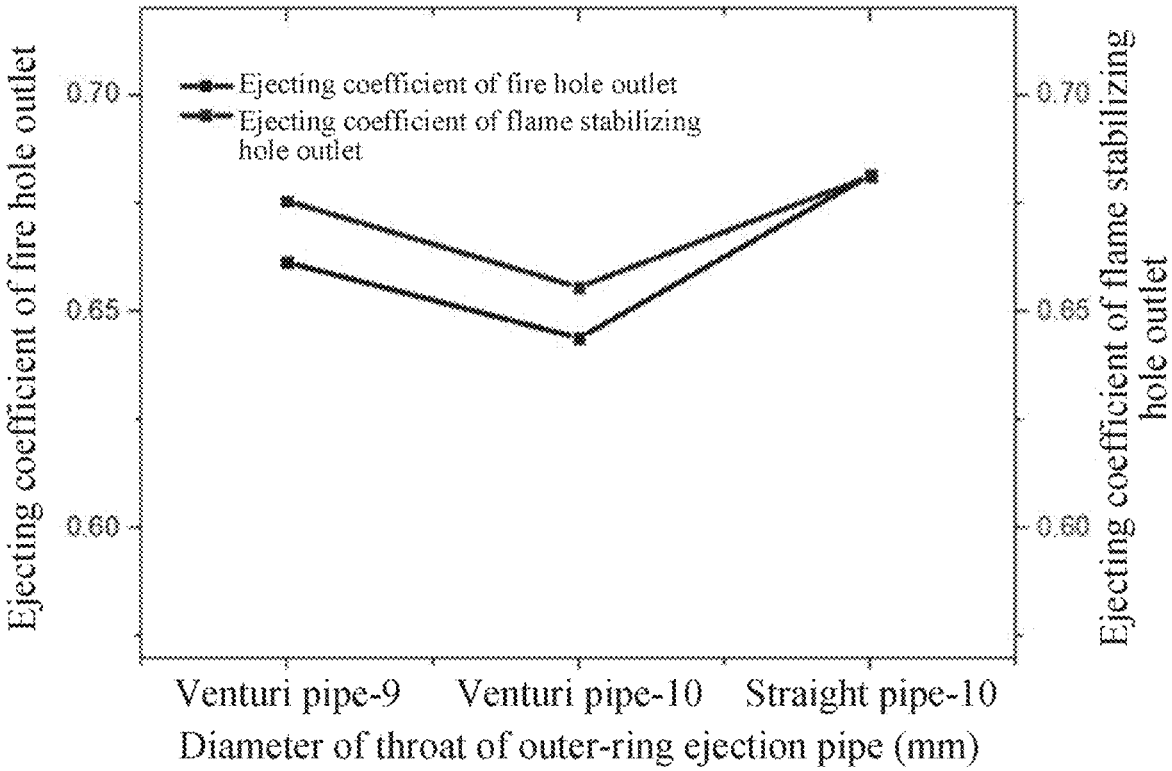
FIG. 9 is a relationship diagram between a diameter of a throat of an outer-ring ejection pipe and ejecting coefficients of a fire hole and a flame stabilizing hole of a burner cap.

Taking a hole diameter of a throat of the outer-ring ejection pipe being a target parameter as a variable, a relationship between an ejecting coefficient of an outlet of the burner cap fire hole 31 and an ejecting coefficient of an outlet of a pressure stabilizing hole is as shown in FIG. 9 by simulating and calculating different hole diameter values, and it can be known from analysis that:

when a diameter of a throat of a tapering section of an outer-ring Venturi pipe increases from 9 mm to 10 mm, the ejecting coefficient of the outlet of the fire hole 31 decreases gradually, and the maximum is 0.68; and the ejecting coefficient of the outlet of the flame stabilizing hole 32 also decreases gradually, and the maximum is 0.66; when the length of a throat pipe extends to form a strip-shaped straight pipe structure, the diameter of the throat of the tapering section is adjusted as 10 mm; and compared with a form of using a Venturi pipe, the throat in the strip-shaped straight pipe form has a higher ejecting coefficient, the ejecting coefficient of the fire hole 31 is 0.69, and the ejecting coefficient of the flame stabilizing hole 32 is 0.69.

It can be known by analyzing FIG. 8 and FIG. 9 that, when the overall burner has an optimum ejecting coefficient, an optimum value of a hole diameter of the throat section 63 of the ejection channel 60 communicated with the inner-ring gas mixing chamber 11 ranges from 6 mm to 8 mm; and an optimum value of a hole diameter of the throat section 63 of the ejection channel 60 communicated with the outer-ring gas mixing chamber 12 ranges from 9 mm to 10 mm.

An optimum value of a hole diameter of the throat section 63 of the ejection channel 60 communicated with the inner-ring gas mixing chamber 11 is 8 mm; and an optimum value of a hole diameter of the throat section 63 of the ejection channel 60 communicated with the outer-ring gas mixing chamber 12 is 10 mm. The overall throat section 63 is arranged in a strip-shaped equal-hole-diameter straight pipe structure.

Figure 10:
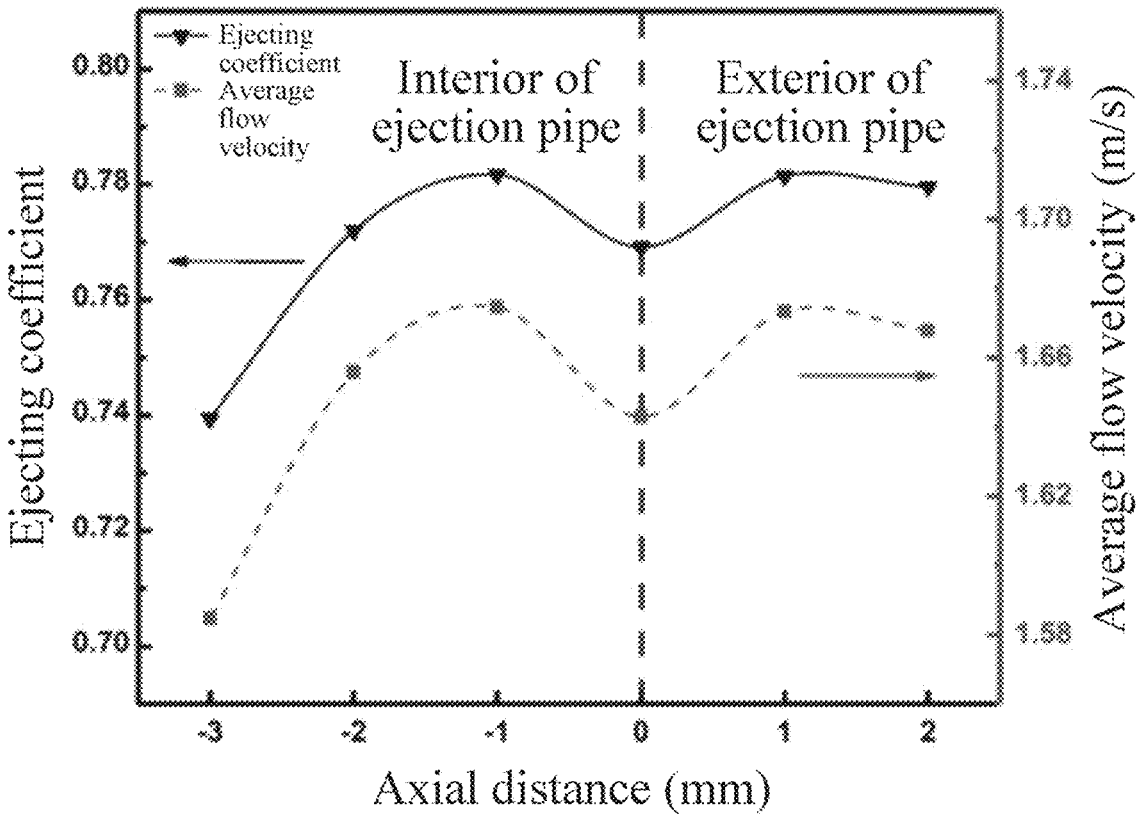
FIG. 10 is a relationship diagram between an axial distance between an ejection pipe inlet of a central ejection pipe and a gas nozzle and an ejecting coefficient of a burner cap as well as an average flow velocity.

Taking an axial distance between a central ejection pipe inlet 61 and a gas nozzle 50 being a target parameter as a variable, relationships between an average flow velocity of the overall burner and the axial distance and between the ejecting coefficient of the burner cap fire hole 31 and the axial distance are as shown in FIG. 10 by simulating and calculating different axial distance values. When the gas nozzle 50 is trapped into the ejection pipe inlet 61, the axial distance is a negative number. It can be known from analysis that:

if it is desired to obtain high simulation values of the overall ejecting coefficient and the average flow velocity, the optimum value of the axial distance between the central ejection pipe inlet 61 and the gas nozzle 50 is from −2 mm to 2 mm; and when the value of the axial distance between the ejection pipe inlet 61 of the ejection channel 60 communicated with the inner-ring gas mixing chamber 11 and the gas nozzle 50 is −1 mm or 1 mm, the optimum ejecting coefficient and the average flow velocity can be obtained at a central burner cap.

Figure 11:
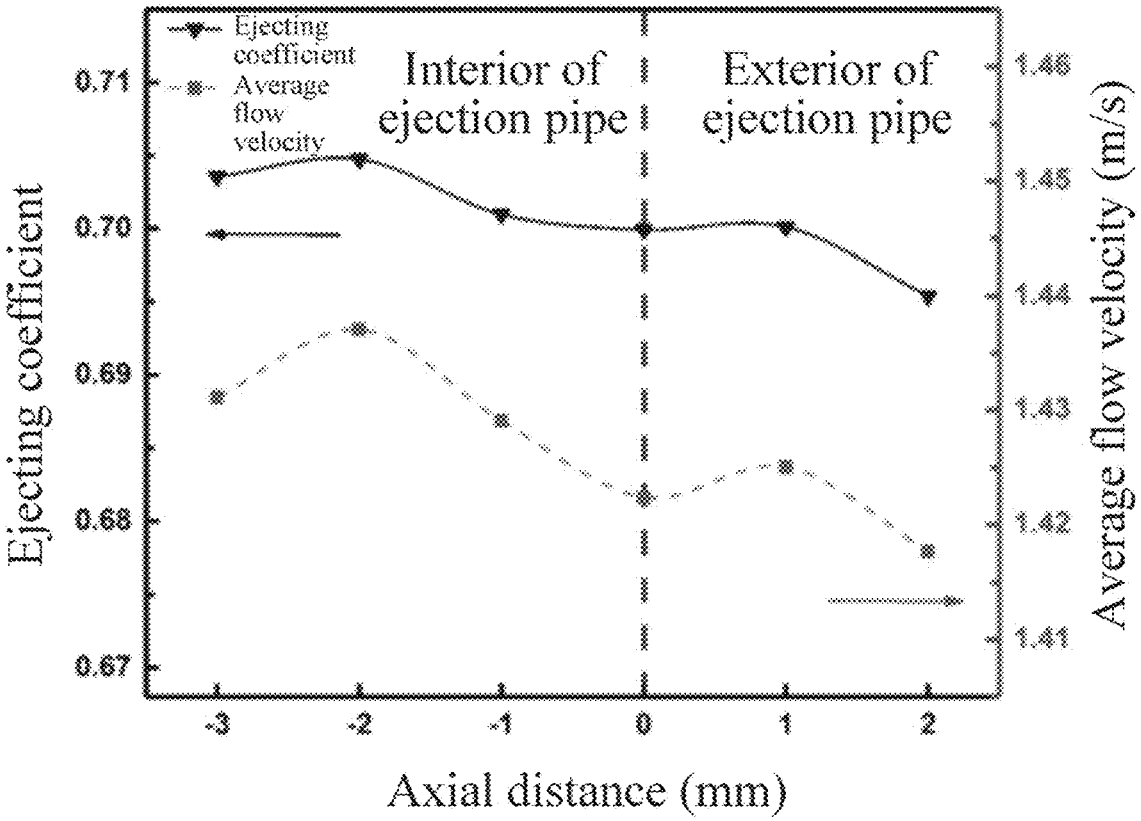
FIG. 11 is a relationship diagram between an axial distance between an ejection pipe inlet of an outer-ring ejection pipe and a gas nozzle and an ejecting coefficient of a burner cap as well as an average flow velocity.

Taking an axial distance between an outer-ring ejection pipe inlet 61 and the gas nozzle 50 being a target parameter as a variable, relationships between an average flow velocity of the overall burner and the axial distance and between the ejecting coefficient of the burner cap fire hole 31 and the axial distance are as shown in FIG. 11 by simulating and calculating different axial distance values. When the gas nozzle 50 is trapped into the ejection pipe inlet 61, the axial distance is a negative number. It can be known from analysis that:

if it is desired to obtain high simulation values of the overall ejecting coefficient and the average flow velocity, the optimum value of the axial distance between the ejection pipe inlet 61 of the ejection channel 60 communicated with the outer-ring gas mixing chamber 12 and the gas nozzle 50 is from −3 mm to 1 mm; and when the value of the axial distance between the ejection pipe inlet 61 of the ejection channel 60 communicated with the outer-ring gas mixing chamber 12 and the gas nozzle 50 is −2 mm, the optimum ejecting coefficient and the average flow velocity can be obtained at an outer-ring burner cap 40.

Figure 12:
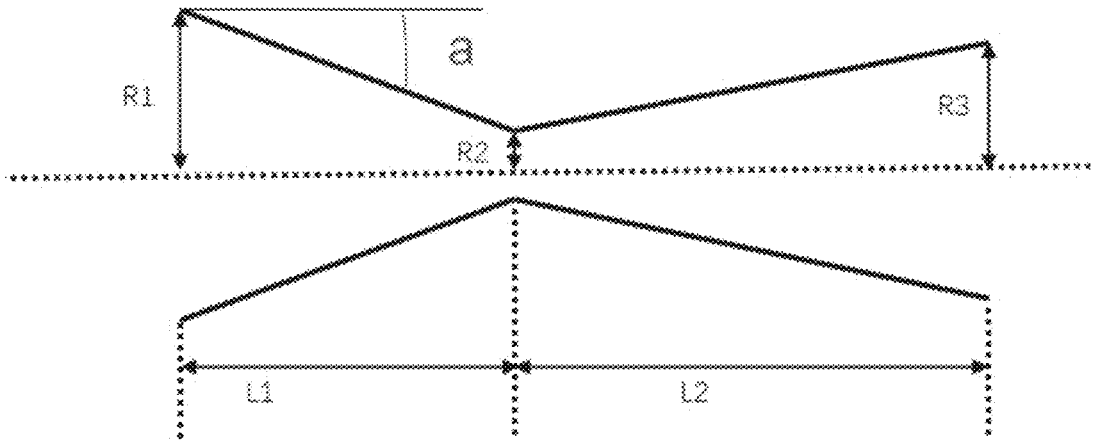
FIG. 12 is a schematic diagram of a size parameter corresponding to the ejection pipe in FIG. 1.

In addition, in the present disclosure, optimized detection for details is also performed on a design value of the cone angle of the contraction section of the ejection pipe. In a testing process, dimension parameters corresponding to the ejection pipe are a shown in FIG. 12, and refer to the following Table 1 for specific parameters:

TABLE 1

| Parameter | R1 | R2 | R3 | L1 | L2 | Nozzle throat diameter |
|---|---|---|---|---|---|---|
| Dimension | 8 mm | 4.3 mm | 6.5 mm | 6 mm | 42 mm | 0.45 mm |

During the simulation process, different tapers a of the contraction section of the ejection pipe can be obtained by changing the magnitude of L1 and keeping other parameters unchanged.

Figure 13:
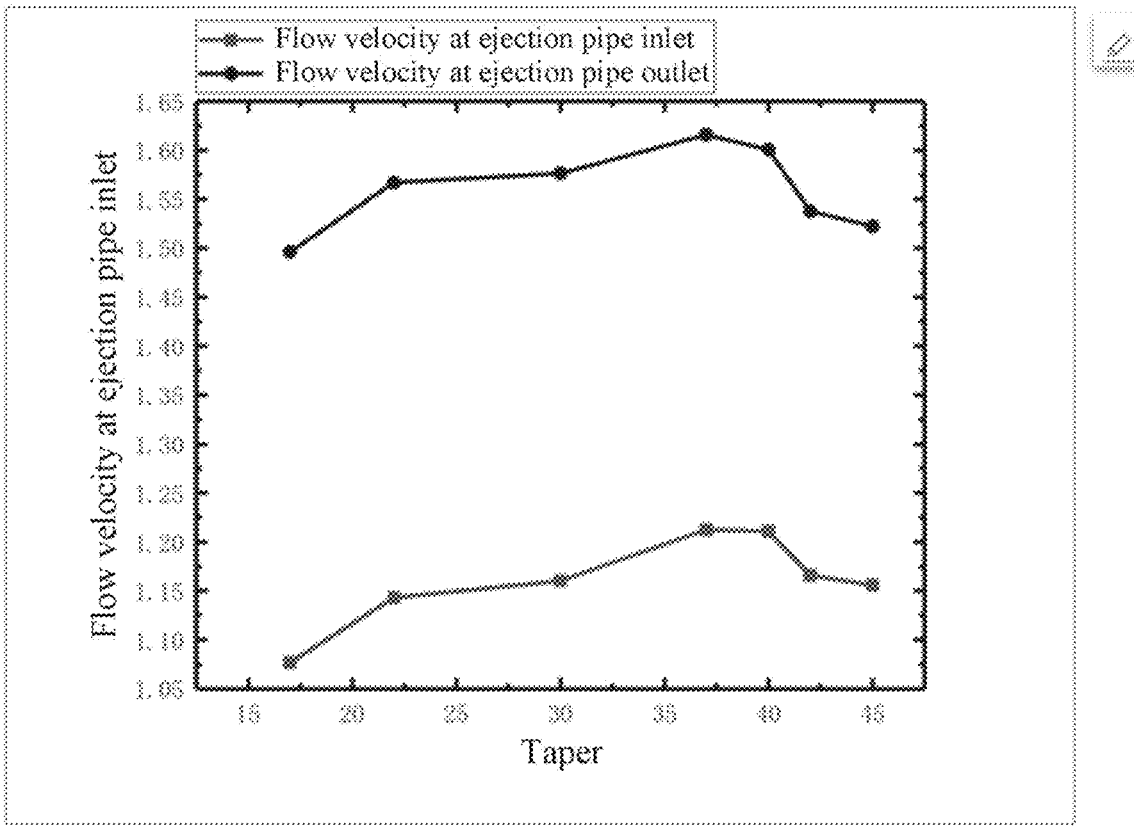
FIG. 13 is a variation curve diagram of flow velocity at ejection pipe inlet and outlet and a cone angle parameter of a contraction section.
Figure 14:
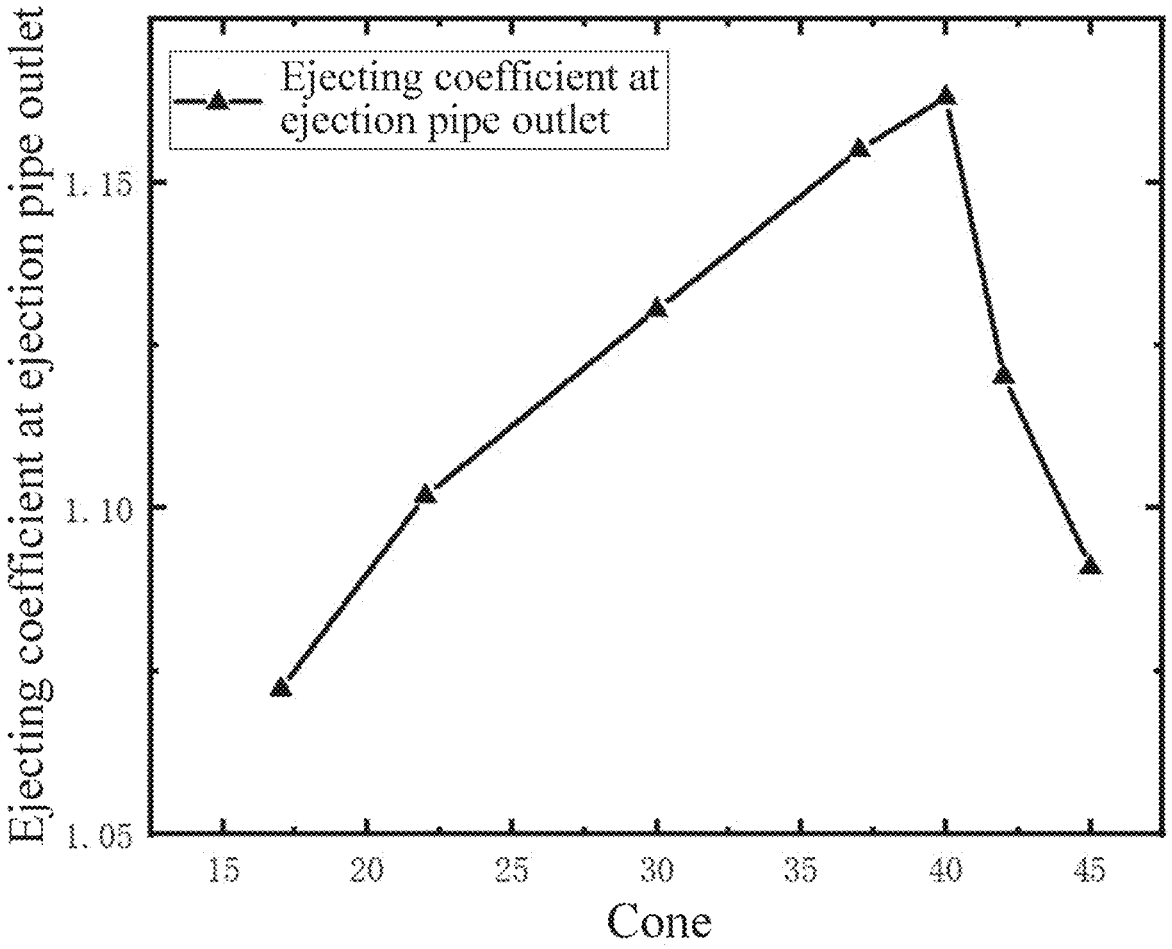
FIG. 14 is a variation curve diagram of an ejecting coefficient of an ejection pipe outlet and a cone angle parameter of a contraction section.

Taking a taper value of the contraction section 62 of the ejection pipe being a target parameter as a variable, by simulating and calculating the taper values of different contraction sections 62: a variation curve diagram of flow velocity at the ejection pipe inlet 61 and an ejection pipe outlet 65 and a taper of the contraction section 62 is as shown in FIG. 13; and a variation curve diagram of an ejecting coefficient of the ejection pipe outlet 65 and a cone angle parameter of the contraction section 62 is as shown in FIG. 14. It can be known by analyzing FIG. 13 and FIG. 14 that:

the flow velocity at the ejection pipe inlet 61 and outlet is in a trend of increasing first and then decreasing as the taper of the ejection pipe increases; a high value appears when the cone angle is in a range from 35° to 40°, and reaches a peak value near 37°; the ejecting coefficient of the ejection pipe outlet 65 is in a trend of increasing first and then decreasing as the taper of the ejection pipe increases; and there is a little difference between the ejecting coefficient at 35° and the ejecting coefficient at 40°, and reaches a peak value near 37°.

It can be known from analysis that the value of the cone angle of the contraction section 62 corresponding to an optimum ejecting coefficient of the ejecting pipe structure ranges from 35° to 40°, and the value of the optimum cone angle is near 37°.

Figure 15:
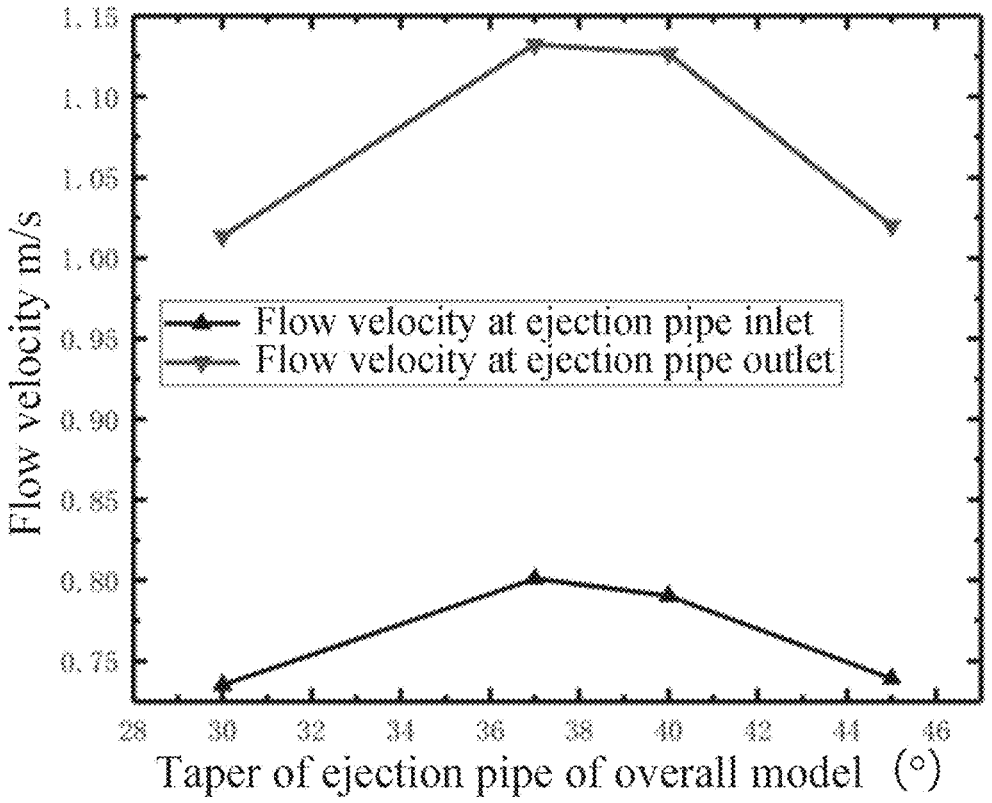
FIG. 15 is a variation curve diagram of flow velocity at ejection pipe inlet and outlet and a cone angle parameter of a contraction section in an overall burner.
Figure 16:
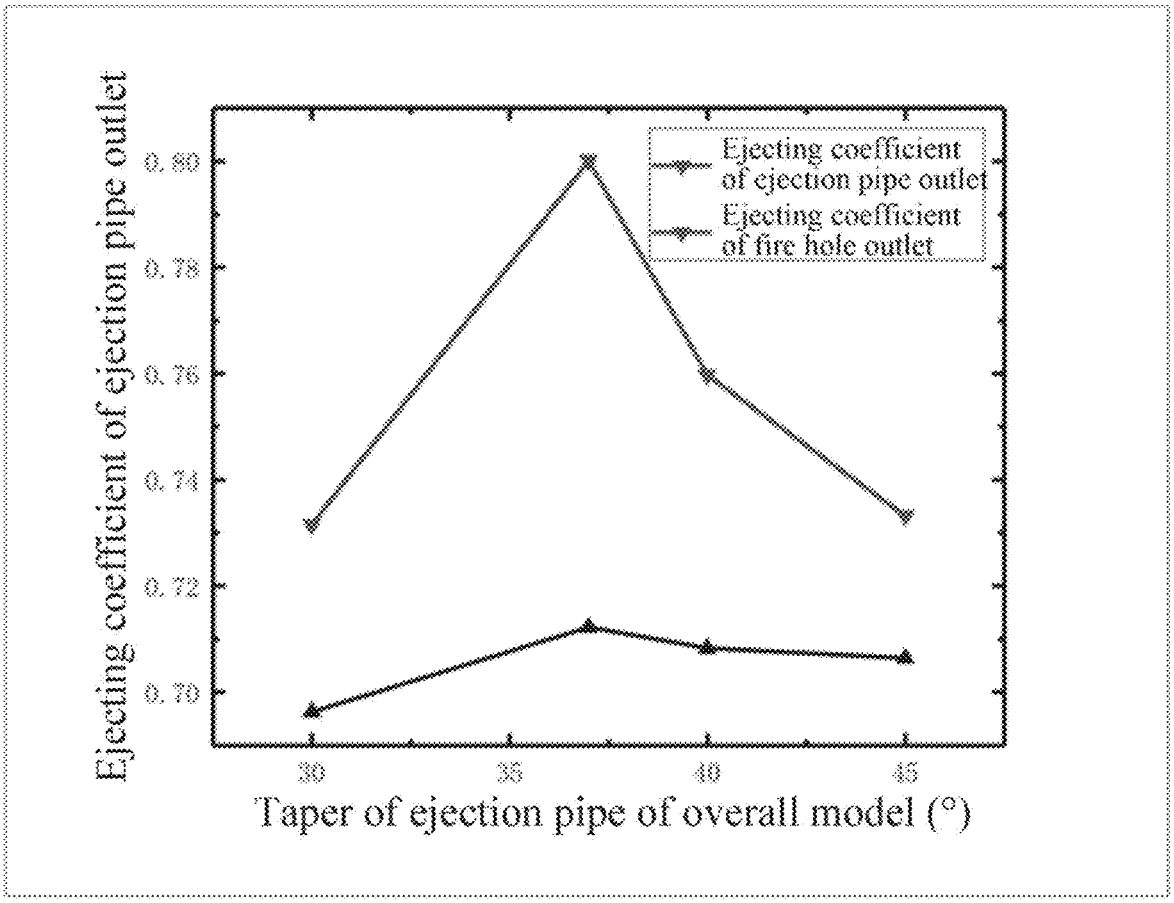
FIG. 16 is a comparative variation curve diagram of an ejecting coefficient at a burner cap output fire hole, an ejecting coefficient of an ejection pipe outlet, and a cone angle parameter of a contraction section of an ejection pipe of an overall burner.

In order to match the overall burner for checking and verifying, the cone angle of the ejection pipe is correlated with the ejecting coefficient output from the fire hole 31 at the burner cap of the overall burner to detect whether the ejection performance of a final output position of the overall burner is matched with a simulation result of an individual ejection pipe. FIG. 15 is a variation curve diagram of the flow velocity at the ejection pipe inlet 61 and the ejection pipe outlet and a cone angle parameter of the contraction section 62 in the overall a burner; and FIG. 16 is a comparative variation curve diagram of an ejecting coefficient at a burner cap output fire hole 31, an ejecting coefficient of the ejection pipe outlet 65, and a cone angle parameter of the contraction section 62 of the overall burner.

In a simulation model of the cone angle of the contraction section 62 of an ejection pipe structure and a simulation model of the overall burner, the change rules of the ejecting coefficient at the burner cap output fire hole 31 and the ejecting coefficient at the ejection pipe outlet 65 are consistent, and are in a trend of increasing first and then decreasing. Specifically, the value of the cone angle of the contraction section 62 corresponding to an optimum ejecting coefficient of the ejecting pipe structure and an optimum ejecting coefficient of the output fire hole of the burner cap ranges from 35° to 40°, and the value of the optimum cone angle is near 37°.

According to the present disclosure, optimized simulation adjustment for details is also further performed on a dimension design of the gas nozzle 50. Specifically, an air channel is arranged in the axial direction of the gas nozzle 50. The air channel is provided with an air inlet section 51, an air ejection section 53, and an air outlet section 54 in sequence. The air inlet section 51 is of a cone angle-shaped structure that gradually contracts; a nozzle throat 52 is also arranged between the air inlet section 51 and the air ejection section 53; and a plurality of nozzle ejection ports 531 are formed in the periphery of the air ejection section 53 in a radial direction.

Figure 17:
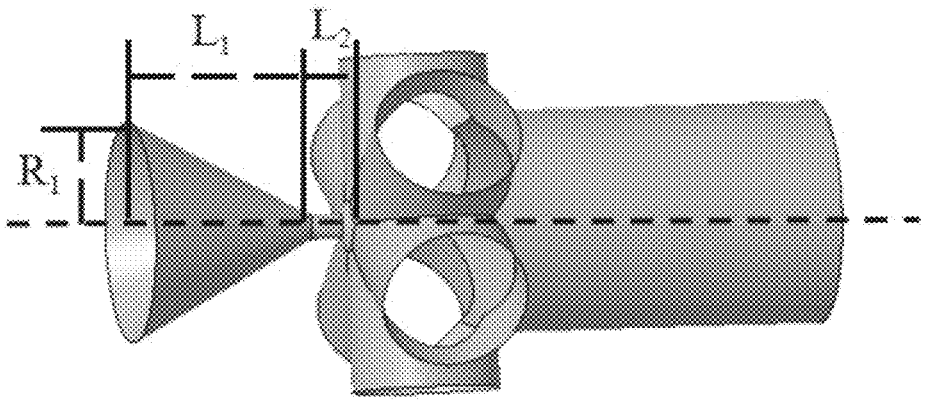
FIG. 17 is a schematic diagram of dimension parameters corresponding to a simulation geometric model established for a gas nozzle in FIG. 1.

In a testing process, dimension parameters corresponding to the established gas nozzle simulation model are as shown in FIG. 17, which are specifically shown in the following Table 2:

TABLE 2

| Parameter | Dimension |
|---|---|
| R1 | 3 mm |
| L1 | 1.5 mm |
| L2 | 1 mm |
| Nozzle throat diameter | 0.45 mm |
| Cone angle of tapering section of nozzle inlet section | 28°/30°/37°/45°/53° |
| Diameter of nozzle ejection port | 2/3/4/5/6 mm |

Two target parameters of the cone angle of the tapering section of the nozzle inlet section and the diameter of the nozzle ejection port are taken as variables, and then ejection performance such as the ejecting coefficient of a nozzle outlet of an outlet end of the gas nozzle, the flow velocity of the nozzle outlet, and the flow velocity of the nozzle ejection port are simulated and calculated. Analysis data is as shown in the following Table 3:

TABLE 3

| Value Parameter | Angle of contraction section of nozzle inlet section (°) | Diameter of nozzle ejection port (mm) | Ejecting coefficient of nozzle outlet | Flow velocity of nozzle outlet (m/s) | Flow velocity of nozzle ejection port (m/s) |
|---|---|---|---|---|---|
| Cone | 28 | 4 | 0.378694728 | 5.296165 | 1.7259657 |
| angles of | 30 | 4 | 0.390467458 | 5.0267956 | 1.7181524 |
| different | 37 | 4 | 0.396094741 | 4.9746344 | 1.7018238 |
| nozzle inlet | 45 | 4 | 0.365834827 | 5.2411766 | 1.718965 |
| sections | 53 | 4 | 0.373655176 | 5.1582684 | 1.714419 |
| Different | 37 | 2 | 0.312909704 | 4.0265277 | 4.9101665 |
| nozzle | 37 | 3 | 0.373927586 | 4.7722365 | 2.6951059 |
| ejection port | 37 | 5 | 0.378659906 | 5.2034311 | 1.0949776 |
| diameters | 37 | 6 | 0.393019325 | 5.9982292 | 0.89263665 |

Figure 18:
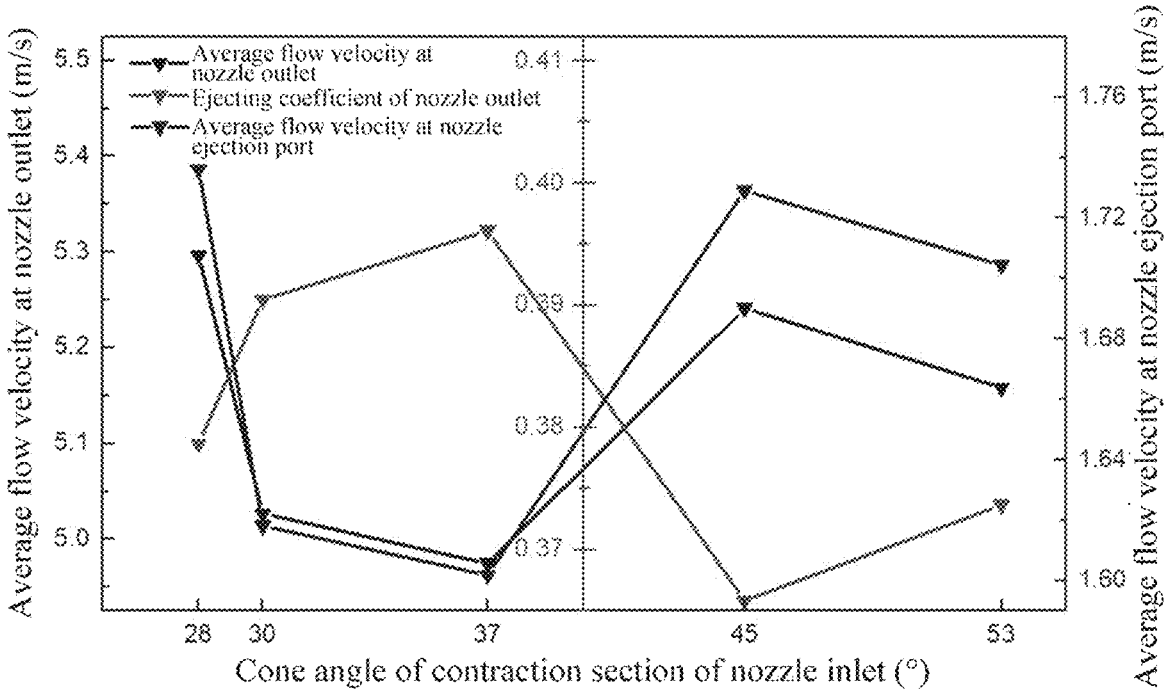
FIG. 18 is a variation curve diagram of various items of ejection performance of a gas nozzle and a cone angle parameter of a contraction section of a nozzle inlet.
Figure 19:
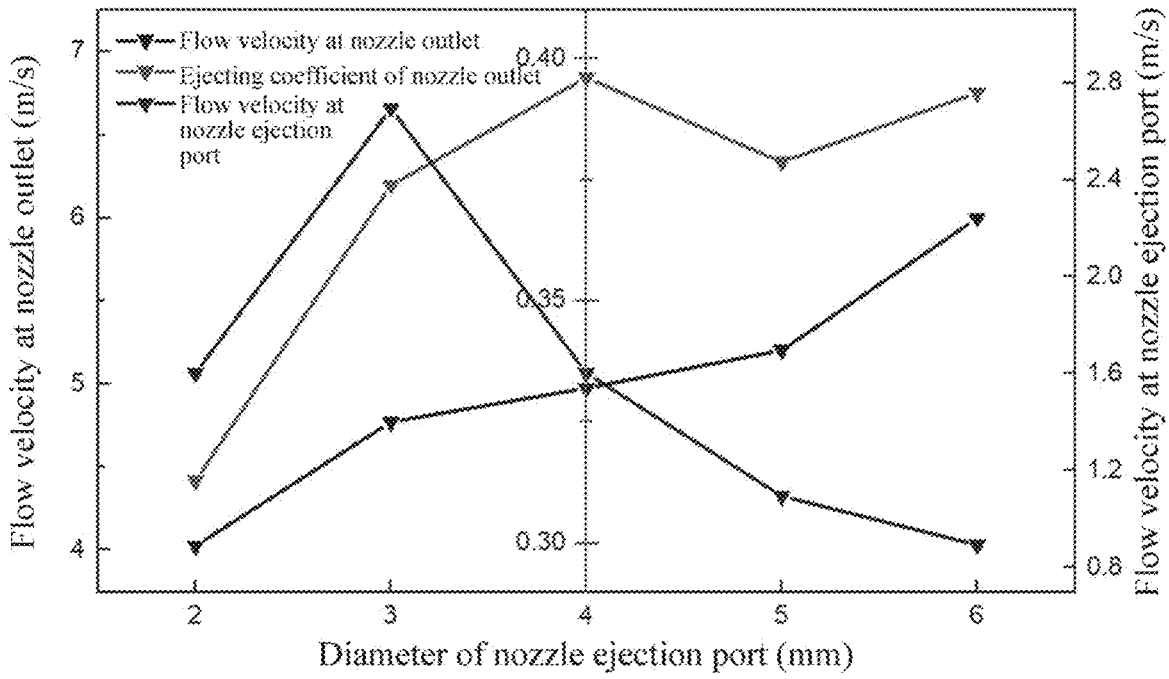
FIG. 19 is a variation curve diagram of various items of ejection performance of a gas nozzle and a hole parameter of a nozzle ejection port.

Variation curve diagrams as shown in FIG. 18 and FIG. 19 are respectively drawn according to various items of ejection performance parameters simulated and calculated in Table 3.

In a structure of the gas nozzle 50, by analyzing a variation curve diagram of various items of ejection performance and a cone angle parameter of the contraction section 62 of a nozzle inlet in Table 3 and FIG. 18, it can be known that:

The ejecting coefficient of the nozzle outlet is in a trend of increasing first and then decreasing as the angle of the contraction section 62 of the nozzle inlet increases; and as the angle of the contraction section 62 of the nozzle inlet increases, the average flow velocity of the nozzle outlet decreases first and then increases.

By analyzing a variation curve diagram of various items of ejection performance and a hole diameter parameter of the nozzle ejection port 531 in Table 3 and FIG. 19, it can be known that: as the diameter of the nozzle ejection port 531 increases, both the ejecting coefficient at the nozzle outlet and the flow velocity of the outlet increase.

In a case of meeting optimum ejection performance, the value of the cone angle ranges from 37° to 45°, and the value of the hole diameter of the nozzle ejection port 531 ranges from 3 mm to 6 mm.

In order to match the overall burner for checking and verifying, the cone angle of the gas nozzle 50 is correlated with the ejecting coefficient output from the fire hole 31 at the burner cap of the overall burner to detect whether the ejection performance of a final output position of the overall burner is matched with a simulation result of an individual gas nozzle 50.

In the comparative analysis, various parameters of the gas nozzle structure are collected from the parameters and design values as shown in the following Table 4:

TABLE 4

| Parameter | Dimension |
|---|---|
| Nozzle throat diameter | 0.45 mm |
| Cone angle of tapering section of nozzle inlet | 28°/30°/37°/45°/53° |
| Diameter of nozzle ejection port | 2/3/4/5/6 mm |

Figure 20:
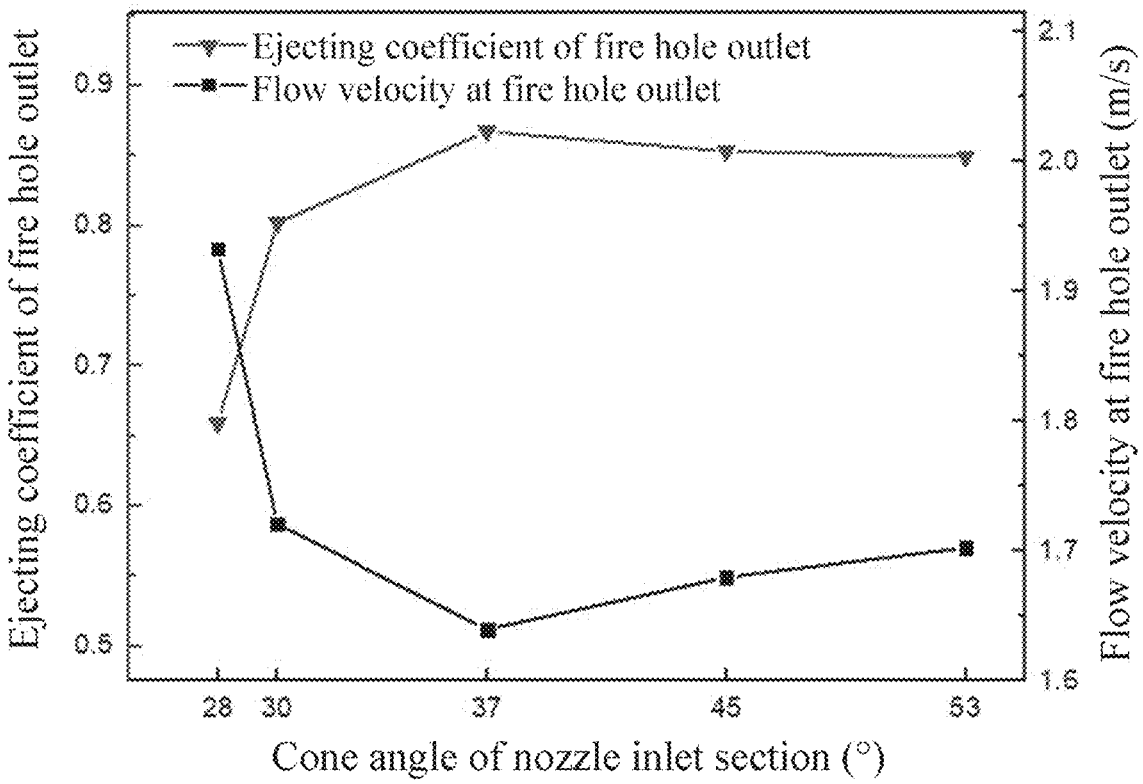
FIG. 20 is a variation curve diagram of various items of ejection performance of a burner cap output fire hole and a cone angle parameter of a contraction section of a nozzle inlet of a burner.
Figure 21:
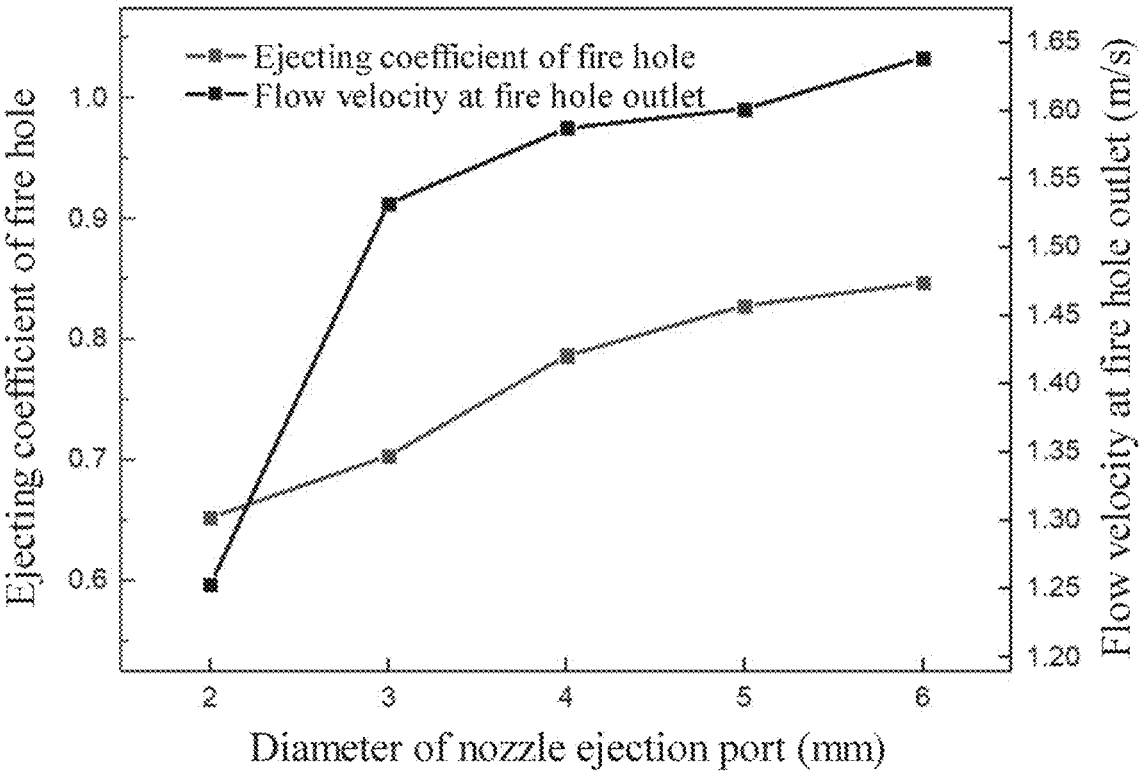
FIG. 21 is a variation curve diagram of various items of ejection performance of a burner cap output fire hole and a hole diameter parameter of a nozzle ejection port of a burner.

Two target parameters of the cone angle of the tapering section of the nozzle inlet section and the diameter of the nozzle ejection port 531 are taken as variables, and then ejection performance such as the ejecting coefficient at a final gas output position of the burner, that is, at an outlet of the fire hole 31 at the burner cap output fire hole 31 and the flow velocity at the outlet of the fire hole 31 are simulated and calculated. Analysis data is as shown by the variation curves in FIG. 20 and FIG. 21.

In combination with the components of the gas nozzle 50 and the ejection performance of an output port of a burner cap fire hole 31 of the overall burner applying the gas nozzle 50, it can be known by analysis that the optimum value of the cone angle of the air inlet section 51 ranges from 37° to 45°, and an optimal value is 37°. An optimum value of the hole diameter of the nozzle ejection port 531 ranges from 3 mm to 6 mm, and an ideal value ranges from 5 mm to 6 mm.

Figure 5:
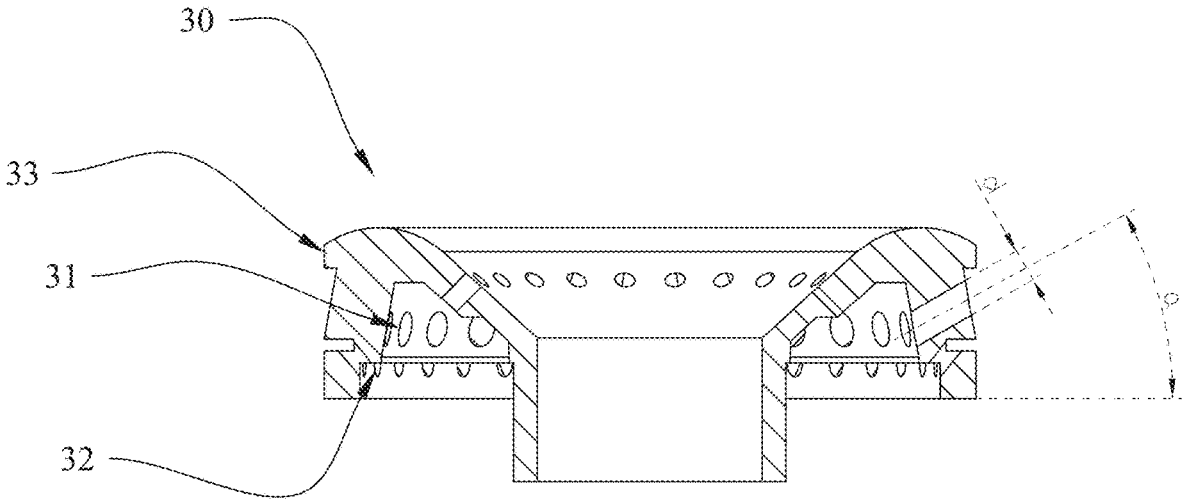
FIG. 5 is a sectional view of an inner-ring burner cap in FIG. 4.
Figure 6:
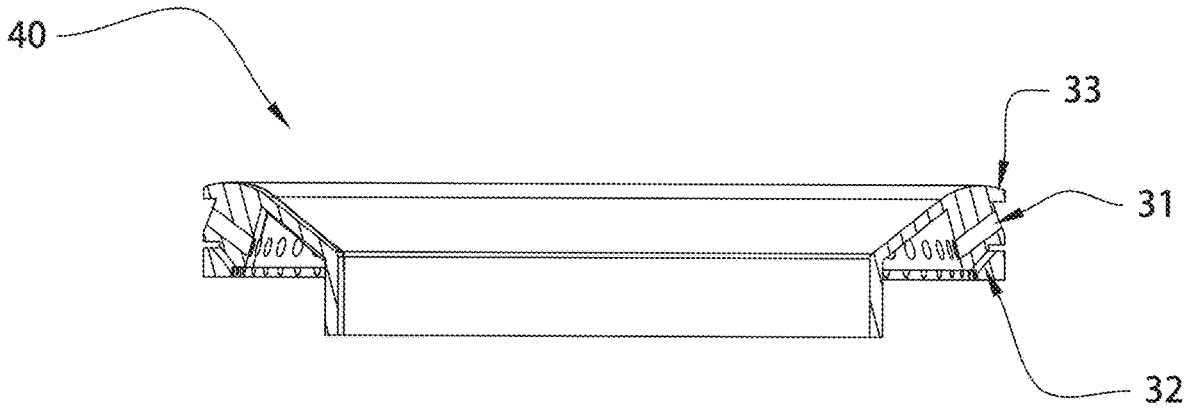
FIG. 6 is a sectional view of an outer-ring burner cap in FIG. 4.
Figure 7:
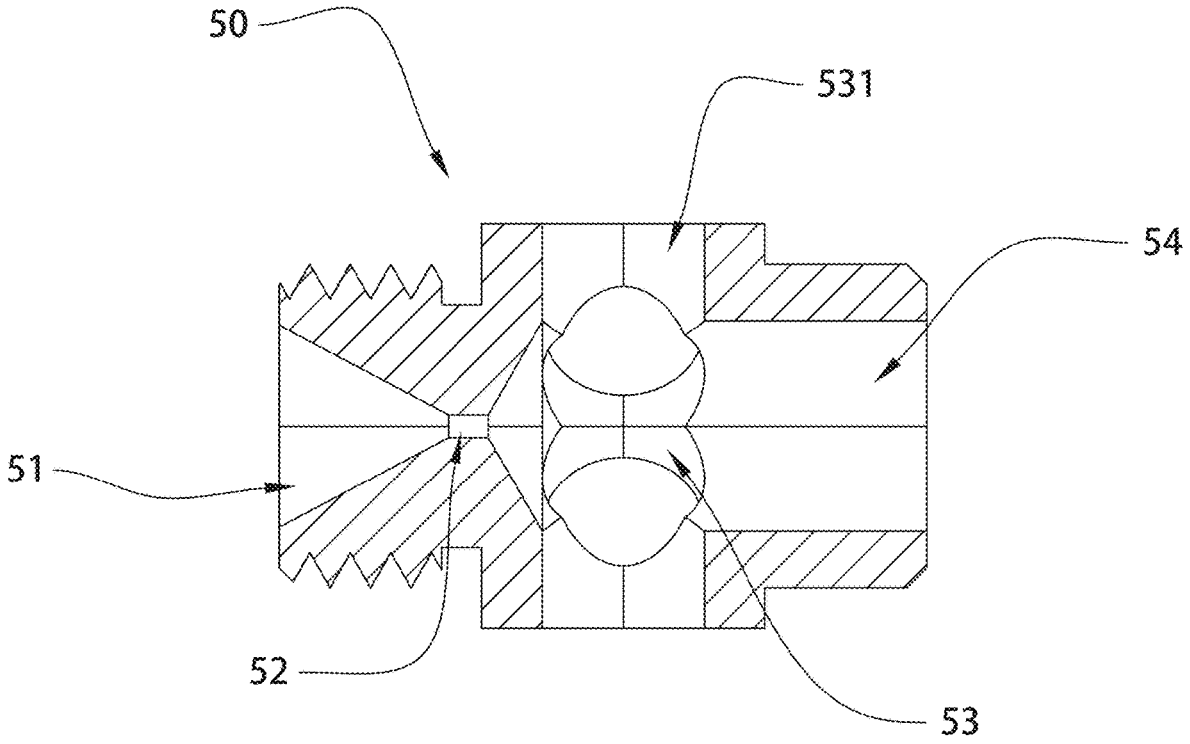
FIG. 7 is a sectional view of a gas nozzle in FIG. 4.

According to the present disclosure, optimized simulation adjustment for details is also further performed on a dimension design of the burner cap. Refer to FIG. 5 and FIG. 6 for a sectional structure of the burner cap.

Figure 22:
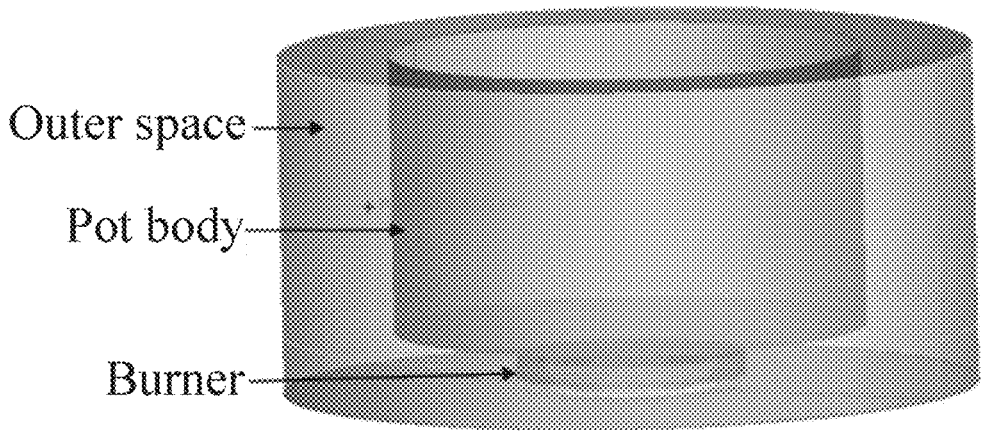
FIG. 22 is a simulation geometric model established for a pot using environment corresponding to the burning system.

The applicant has correspondingly established the simulation geometric model established for a pot using environment corresponding to a burning system as shown in FIG. 22, which is used for simulating the relationship between parameters such as the ejection performance at the simulated fire hole 31, the simulated heat efficiency of the overall burner, and a CO emission value and an inclination angle of the burner cap fire hole 31 and the hole diameter of the fire hole 31.

In the comparative analysis, considering the influence of a single variable, simulation analysis is performed by only changing the single variable of the inclination angle a or the hole diameter d of the fire hole 31 of the outer-ring burner cap 40 without changing a central burner cap.

A simulation test is performed by taking the inclination angle a of the fire hole 31 of the outer-ring burner cap 40 as a single variable, the hole diameter of the fire hole 31 is maintained consistent, and simulation calculation is performed on pot body bottom surface absorption heat, pot body side surface absorption heat, pot body absorption heat, a heat load simulation value, simulated heat efficiency, the CO emission value, and the like. Analysis data is as shown in the following Table 5:

TABLE 5

| Model | Pot body bottom surface absorption heat | Pot body side surface absorption heat | Pot body absorption heat | Heat load simulation value | Simulated heat efficiency | CO emission (PPM) |
|---|---|---|---|---|---|---|
| 125(25°) | 889 | 2192 | 3081 | 5089 | 60.55% | 330 |
| 125(30°) | 861 | 2318 | 3179 | 5093 | 62.67% | 503 |
| 125(37°) | 836 | 2420 | 3256 | 5105 | 63.78% | 653 |
| 125(45°) | 821 | 2486 | 3307 | 5090 | 64.43% | 795 |

Figure 23:
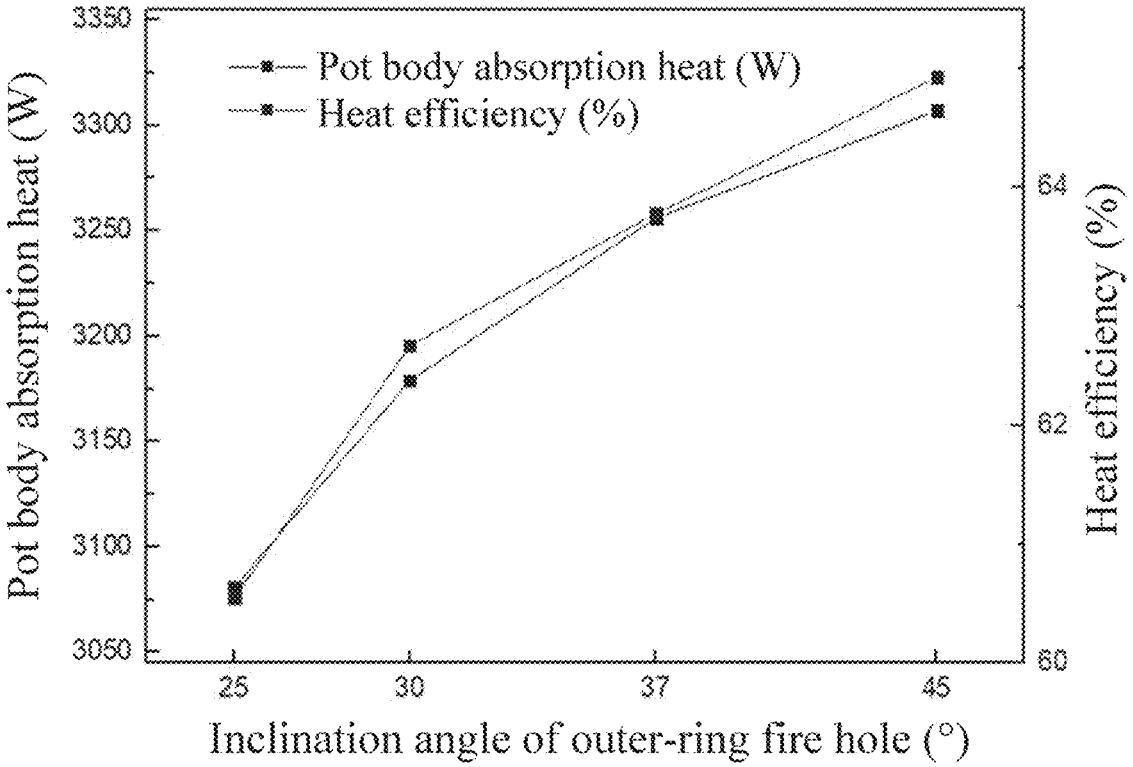
FIG. 23 is a variation curve diagram of pot body heat, heat efficiency, and an inclination angle parameter of a fire hole of a burner cap in FIG. 22.
Figure 24:
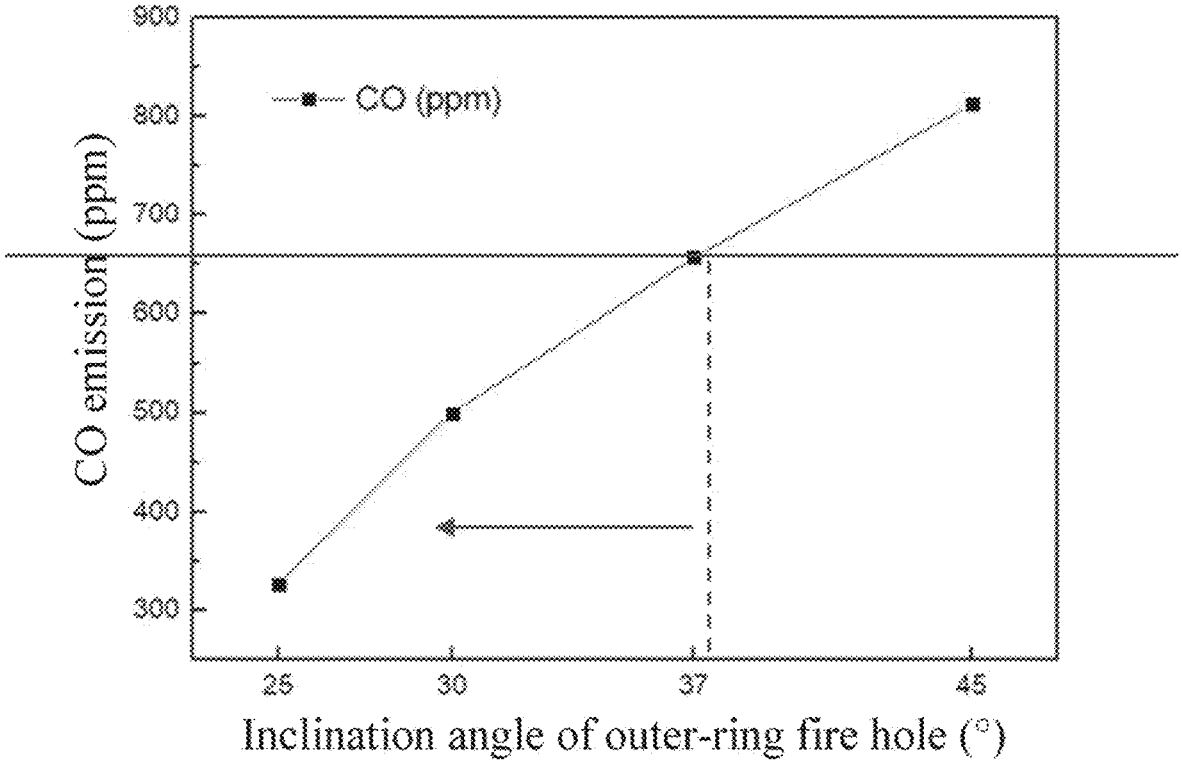
FIG. 24 is a variation curve diagram of CO emission and an inclination angle parameter of a fire hole of a burner cap in FIG. 22.

The simulated heat efficiency can be calculated according to the ratio of the pot body absorption heat to the simulated heat load output by the burner calculated according to Table 4, and the variation curve diagram of the pot body heat and the heat efficiency and the inclination angle parameter of the fire hole as shown in FIG. 23 can be obtained correspondingly. Moreover, the variation curve diagram of the CO emission and the inclination angle parameter of the fire hole as shown in FIG. 24 can be further obtained correspondingly. It can be known from corresponding analysis that:

In a state of using the overall burner, the simulated heat efficiency of the pot body absorption heat gradually increases as the inclination angle increases; and the CO emission also gradually increases as the inclination angle increases. Considering a requirement of national standards that the CO emission value of a gas stove should not exceed 500 PPM, the value of the inclination angle of the fire hole may range from 30° to 45°. The ideal value ranges from 35° to 40°. Further, the optimum design value of the inclination value is 37°.

Further, a simulation test is performed by taking the hole diameters d of the fire holes and the flame stabilizing holes of the central burner cap and the outer-ring burner cap as a single variable, the inclination angles of the fire holes are kept consistent, and the simulation is performed on the ejecting coefficient of a fire hole outlet and the flow velocity of the fire hole outlet. Analysis data is as shown in the following Table 6.

TABLE 6

| | Ejecting coefficient of fire hole outlet | | | | Flow velocity of fire hole outlet (m/s) | | | |
|---|---|---|---|---|---|---|---|---|
| | Hole diameter | | | | | | | |
| | 2.6 mm | 2.7 mm | 2.8 mm | 2.9 mm | 2.6 mm | 2.7 mm | 2.8 mm | 2.9 mm |
| Central fire hole | 0.7069 | 0.7050 | 0.7089 | 0.6943 | 1.95947 | 1.90594 | 1.90837 | 1.85299 |
| Central flame stabilizing hole | 0.7047 | 0.7039 | 0.7072 | 0.6940 | 1.84252 | 1.73861 | 1.75490 | 1.76160 |
| Outer-ring fire hole | 0.6746 | 0.7007 | 0.7051 | 0.6357 | 1.35219 | 1.38939 | 1.43312 | 1.18379 |
| Outer-ring flame stabilizing hole | 0.6761 | 0.7025 | 0.7077 | 0.6061 | 1.02303 | 1.01576 | 1.00609 | 1.05775 |

Further, simulation calculation is performed on the pot body bottom surface absorption heat, the pot body side surface absorption heat, the pot body absorption heat, the heat load simulation value, the simulated heat efficiency, the CO emission value, and the like. Analysis data is as shown in the following Table 7:

TABLE 7

| Model | Pot body bottom surface absorption heat | Pot body side surface absorption heat | Pot body absorption heat | Heat load simulation value | Simulated heat efficiency |
|---|---|---|---|---|---|
| 125 (2.6 mm) | 861 | 2318 | 3179 | 5093 | 62.67% |
| 125 (2.7 mm) | 893 | 2352 | 3245 | 5131 | 63.2% |
| 125 (2.8 mm) | 931 | 2580 | 3511 | 5204 | 63.9% |
| 125 (2.9 mm) | 980 | 2623 | 3278 | 5297 | 61.9% |

Figure 25:
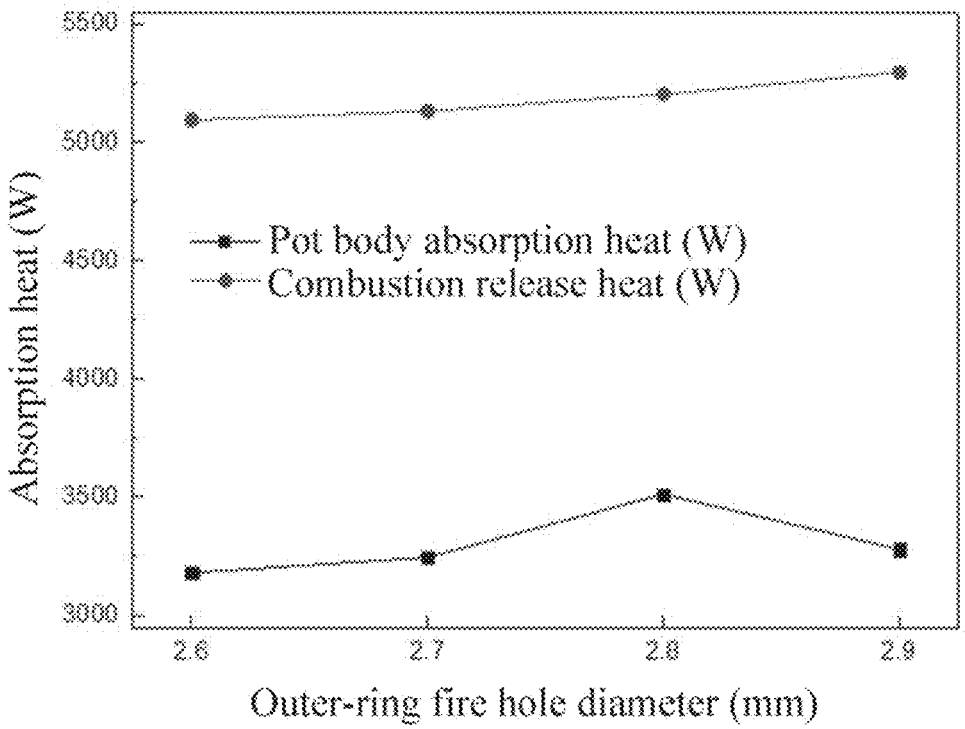
FIG. 25 is a variation curve diagram of burner release heat, pot body absorbed heat, and a hole parameter of a fire hole of a burner cap in FIG. 22.
Figure 26:
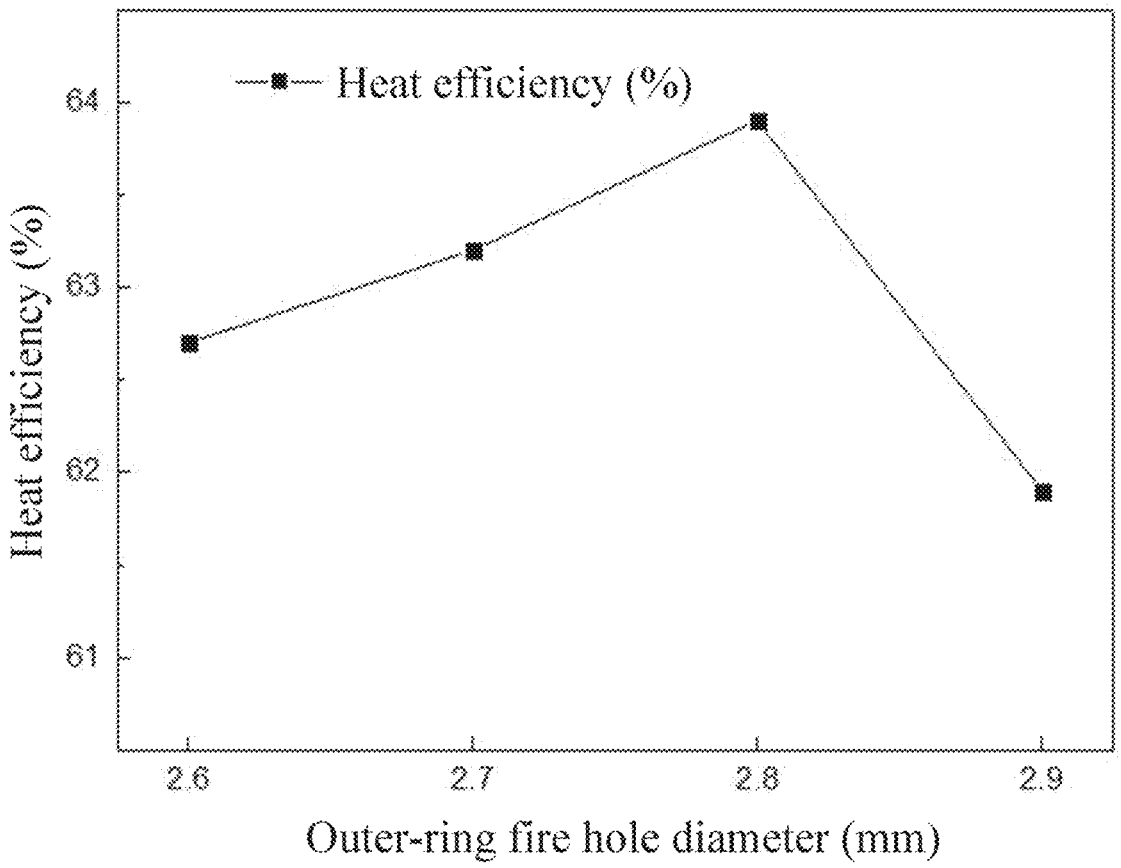
FIG. 26 is a variation curve diagram of simulated heat efficiency and a hole diameter parameter of a fire hole in FIG. 22.

The simulated heat efficiency can be calculated according to the ratio of the pot body absorption heat to the simulated heat load output by the burner calculated according to Table 7, and the variation curve diagram of burner release heat and pot body absorption heat and the hole diameter parameter of the fire hole 31 as shown in FIG. 25 can be obtained correspondingly. Moreover, further, the variation curve diagram of the simulated heat efficiency and the hole diameter parameter of the fire hole 31 as shown in FIG. 26 can be further obtained correspondingly.

In combination with the inclination angle and the hole diameter of the fire hole 31 and in consideration the emission, it can be known by comprehensive analysis that: an optimum value of the inclination angle of the fire hole 31 ranges from 35° to 40°; and an optimum value of the hole diameter of the fire hole 31 ranges from 2.7 mm to 2.9 mm.

As the best selection solution, the value of the inclination angle of the fire hole 31 is 37°; and the value of the hole diameter of the fire hole 31 is 2.8 mm.

In this embodiment, a plurality of flame stabilizing holes 32 are formed in an outer edge of a burner cap body; the flame stabilizing holes 32 are uniformly distributed on the periphery of the burner cap body in a circumferential direction; and the heights of the flame stabilizing holes 32 and the fire holes 31 at the burner cap body are different. In order to make the flame burning of the burner cap more stable, the flame is output through the flame stabilizing holes 32 to heat the gas output from the fire hole 31, so that the gas can be stably burnt at the position of the fire hole 31, thereby achieving an effect of stabilizing a flame.

A shield 33 extends towards the outside in a radial direction of an outer edge of the top of the burner cap body, and the shield 33 can block the fire hole 31 and the flame stabilizing holes 32 below. Oil stains on the top surface of the burner cap will directly drip at the outer edge of the shield 33, which effectively prevents the oil stains from entering the fire hole 31 or the flame stabilizing holes 32.

In this embodiment, the ejection pipe component 20 includes an ejection pipe seat 21 and an ejection pipe cap 22 that are capable of being disassembled and assembled; and the ejection pipe cap 22 is capable of being embedded into the ejection pipe seat 21, and encloses to form the ejection channel 60. Due to the ejection pipe seat 21 and the ejection pipe cap 22 that are capable of being disassembled and assembled, the ejection pipe seat 21 and the ejection pipe cap 22 may be machined respectively and made into the ejection pipe component subsequently through processes such as pressing, which ensures a pipeline profile of the ejection channel 60, and meets a design model better.

By simulating and optimizing various dimensions and structures of the upside-entrainment burning system, size design selection values of various main elements corresponding to an optimum ejection capability of the upside-entrainment burning system are obtained, so as to form an energy-efficient upside-entrainment burning system with the optimum ejection capability.

Of course, the present disclosure is not limited to the above implementation manners. Technicians familiar with this field can also make equivalent deformations or replacements without violating the spirit of the present disclosure. Those of ordinary skill in the art may also make equivalent deformations and replacements without departing from the spirit of the present utility model. These equivalent deformations and replacements all included in the scope of the claims of the present application.

What is claimed is:

1. An energy-efficient upside-entrainment burning system, comprising a gas distributor component, an ejection pipe component, an outer-ring burner cap, an inner-ring burner cap, and a plurality of gas nozzles, wherein the gas distributor component is provided with an inner-ring gas mixing chamber and an outer-ring gas mixing chamber that are arranged annularly; the inner-ring burner cap and the outer-ring burner cap respectively cover above the inner-ring gas mixing chamber and the outer-ring gas mixing chamber;

the ejection pipe component is arranged below the gas distributor component, is provided with ejection channels in a centrosymmetric structure corresponding to the outer-ring gas mixing chamber, and the inner-ring gas mixing chamber;

the gas nozzles are arranged at a gas inlet end of each of the ejection channels;

the ejection channels are arranged in a Venturi pipe structure; and in a gas flowing direction, an ejection pipe inlet, a contraction section, a throat section, an expansion section, and an ejection pipe outlet are arranged in sequence;

the contraction section is of a conical structure that gradually contracts, and a value of a cone angle of the contraction section ranges from 35° to 40°;

wherein an air channel is arranged in an axial direction of the gas nozzles; the air channel is provided with an air inlet section;

wherein a value of a cone angle of the air inlet section ranges from 37° to 45°;

a plurality of fire holes are arranged in circumferential directions of the outer-ring burner cap and the inner-ring burner cap;

a value of an inclination angle of the fire holes ranges from 35° to 40°.

2. The energy-efficient upside-entrainment burning system according to claim 1, wherein a value of a hole diameter of the throat section of the ejection channels communicated with the inner-ring gas mixing chamber ranges from 6 mm to 8 mm; and a value of a hole diameter of the throat section of the ejection channels communicated with the outer-ring gas mixing chamber ranges from 9 mm to 10 mm.

3. The energy-efficient upside-entrainment burning system according to claim 1, wherein a value of an axial distance between the ejection pipe inlet of the ejection channels communicated with the inner-ring gas mixing chamber and the gas nozzles is less than 2 mm; and a value of an axial distance between the ejection pipe inlet of the ejection channels communicated with the outer-ring gas mixing chamber and the gas nozzles is less than 1 mm.

4. The energy-efficient upside-entrainment burning system according to claim 1, wherein the air channel is further provided with an air ejection section and an air outlet section;

the air inlet section is of a cone angle-shaped structure that gradually contracts; a nozzle throat is also arranged between the air inlet section and the air ejection section; and a plurality of nozzle ejection ports are formed in a periphery of the air ejection section in a radial direction.

5. The energy-efficient upside-entrainment burning system according to claim 4, wherein a value of a hole diameter of the nozzle ejection ports ranges from 5 mm to 6 mm.

6. The energy-efficient upside-entrainment burning system according to claim 1, wherein a value of a hole diameter of the fire holes ranges from 2.7 mm to 2.9 mm.

7. The energy-efficient upside-entrainment burning system according to claim 1, wherein the ejection pipe component comprises an ejection pipe seat and an ejection pipe cap that are capable of being disassembled and assembled; and the ejection pipe cap is capable of being embedded into the ejection pipe seat, and encloses to form the ejection channels.

* * * * *